US010024286B2

(12) United States Patent
Brune et al.

(10) Patent No.: US 10,024,286 B2
(45) Date of Patent: Jul. 17, 2018

(54) TAPPET ASSEMBLY FOR USE IN AN INTERNAL COMBUSTION ENGINE HIGH-PRESSURE FUEL SYSTEM

(71) Applicant: GT Technologies, Westland, MI (US)

(72) Inventors: John E. Brune, Stockbridge, MI (US); Scott P. Smith, Temperance, MI (US)

(73) Assignee: GT TECHNOLOGIES, Westland, MI (US)

( * ) Notice: Subject to any disclaimer, the term of this patent is extended or adjusted under 35 U.S.C. 154(b) by 94 days.

(21) Appl. No.: 15/200,092

(22) Filed: Jul. 1, 2016

(65) Prior Publication Data

US 2017/0016418 A1 Jan. 19, 2017

Related U.S. Application Data

(60) Provisional application No. 62/192,653, filed on Jul. 15, 2015.

(51) Int. Cl.

| | |
|---|---|
| ***F01L 1/14*** | (2006.01) |
| ***F02M 59/10*** | (2006.01) |
| ***F02M 59/06*** | (2006.01) |
| ***F04B 1/04*** | (2006.01) |
| ***F01L 1/08*** | (2006.01) |

(Continued)

(52) U.S. Cl.

CPC ..... *F02M 59/102* (2013.01); *F01L 1/08* (2013.01); *F02M 39/02* (2013.01); *F02M 59/06* (2013.01);

(Continued)

(58) Field of Classification Search

CPC ..... F02M 59/102; F02M 59/06; F02M 39/02; F02M 2200/50; F02M 2200/852;

(Continued)

(56) References Cited

U.S. PATENT DOCUMENTS

| | | | |
|---|---|---|---|
| 4,335,685 | A | 6/1982 | Clouse |
| 7,793,583 | B2 | 9/2010 | Radinger et al. |

(Continued)

FOREIGN PATENT DOCUMENTS

| | | | |
|---|---|---|---|
| DE | 19600852 | A1 | 7/1997 |
| DE | 102006059716 | A1 | 6/2008 |

(Continued)

OTHER PUBLICATIONS

Abstract, EP 2386747 A1, Nov. 2011.*
Extended European Search Report regarding European Application No. 16179076.1 dated Oct. 31, 2016.

*Primary Examiner* — Zelalem Eshete
(74) *Attorney, Agent, or Firm* — Howard & Howard Attorneys PLLC

(57) ABSTRACT

A tappet assembly for use in translating force between a camshaft lobe and a fuel pump assembly via reciprocal movement within a tappet cylinder having a guide slot. The tappet assembly includes a bearing assembly having a shaft and a bearing rotatably supported by the shaft for engaging the lobe. An intermediate element has a first aperture, a shelf for engaging the fuel pump assembly, and a pair of arc-shaped bearing surfaces rotatably engaging the shaft when the bearing engages the lobe and the shelf engages the fuel pump assembly. An annular body has a second aperture and at least one stop member abutting the intermediate element to align the first aperture with the second aperture. An anti-rotation clip is disposed so as to extend through the apertures and cooperates with the stop member to substantially prevent rotational and axial movement of the intermediate element with respect to the body.

19 Claims, 23 Drawing Sheets

(51) Int. Cl.
*F02M 39/02* (2006.01)
*F01L 1/047* (2006.01)

(52) U.S. Cl.
CPC ..... *F04B 1/0426* (2013.01); *F01L 1/047* (2013.01); *F01L 2107/00* (2013.01); *F02M 2200/50* (2013.01); *F02M 2200/852* (2013.01)

(58) Field of Classification Search
CPC ..... F01L 1/08; F01L 1/047; F01L 2107/00; F02B 1/0426
See application file for complete search history.

(56) References Cited

U.S. PATENT DOCUMENTS

| | | | | |
|---|---|---|---|---|
| 8,235,018 | B2 | 8/2012 | Dorn et al. | |
| 8,474,427 | B2 | 7/2013 | Dorn et al. | |
| 8,522,643 | B2 | 9/2013 | Dorn et al. | |
| 8,863,716 | B2 | 10/2014 | Dorn et al. | |
| 8,875,676 | B2 | 11/2014 | Geyer et al. | |
| 2010/0294219 | A1 | 11/2010 | Prokop | |
| 2011/0158835 | A1* | 6/2011 | Yabuuchi | F01L 1/143 417/471 |
| 2013/0213181 | A1 | 8/2013 | Dorn et al. | |

FOREIGN PATENT DOCUMENTS

| | | | | |
|---|---|---|---|---|
| DE | 102011085243 | A1 | 5/2013 | |
| EP | 2386747 | A1 * | 11/2011 | F01L 1/14 |
| EP | 2530295 | A1 | 12/2012 | |
| EP | 2853696 | A1 | 4/2015 | |
| EP | 2853738 | A1 | 4/2015 | |
| JP | 2012072704 | A | 4/2012 | |
| WO | 20131119214 | A1 | 8/2013 | |

* cited by examiner

TAPPET ASSEMBLY FOR USE IN AN INTERNAL COMBUSTION ENGINE HIGH-PRESSURE FUEL SYSTEM

CROSS REFERENCE TO RELATED APPLICATIONS

This application claims the benefit of U.S. provisional patent application entitled "Tappet Assembly for Use in an Internal Combustion Engine High-Pressure Fuel System," having Ser. No. 62/192,653, and filed on Jul. 15, 2015.

BACKGROUND OF THE INVENTION

1. Field of Invention

The present invention relates, generally, to high-pressure fuel systems for internal combustion engines and, more specifically, to a tappet assembly for use in an internal combustion engine high-pressure fuel system.

2. Description of the Related Art

Conventional internal combustion engines typically include one or more camshafts in rotational communication with a crankshaft supported in a block, one or more intake and exhaust valves driven by the camshafts and supported in a cylinder head, and one or more pistons driven by the crankshaft and supported for reciprocal movement within cylinders of the block. The pistons and valves cooperate to regulate the flow and exchange of gasses in and out of the cylinders of the block so as to effect a complete thermodynamic cycle in operation. To that end, a predetermined mixture of air and fuel is compressed in the cylinders by the pistons, is ignited, and combusts; thereby transferring energy to the crankshaft via the piston. The mixture of air and fuel can be achieved in a number of different ways, depending on the specific configuration of the engine.

Irrespective of the specific configuration of the engine, contemporary engine fuel systems typically include a pump adapted to pressurize fuel from a source, such as a fuel tank, and direct pressurized fuel to one or more fuel injectors selectively driven by an electronic controller so as to atomize the pressurized fuel, which mixes with air and is subsequently used to effect combustion in the cylinders of the engine.

In so-called "port fuel injection" (PFI) gasoline fuel systems, the fuel injectors are arranged up-stream of the intake valves of the cylinder head, are typically attached to an intake manifold, and are used to direct atomized fuel toward the intake valves which mixes with air traveling through the intake manifold and is subsequently drawn into the cylinders. In conventional PFI gasoline fuel systems, a relatively low fuel pressure of 4 bar (58 psi) is typically required at the fuel injectors. Because of the relatively low pressure demand, the pump of a PFI gasoline fuel system is typically driven with an electric motor.

In order to increase the efficiency and fuel economy of modern internal combustion engines, the current trend in the art involves so-called "direct injection" (DI) fuel system technology, in which the fuel injectors admit atomized fuel directly into the cylinder of the block (rather than up-stream of the intake valves) so as to effect improved control and timing of the thermodynamic cycle of the engine. To this end, modern gasoline DI fuel systems operate at a relatively high fuel pressure, for example 200 bar (2900 psi). Because of the relatively high pressure demand, DI gasoline fuel systems typically utilize a high-pressure fuel pump assembly that is mechanically driven by a rotational movement of a prime mover of the engine, such as one of the camshafts.

Thus, the same camshaft used to regulate the valves in the cylinder head is frequently also used to drive the high-pressure fuel pump assembly in DI fuel systems. To this end, one of the camshafts typically includes an additional lobe that cooperates with a tappet supported in a housing to translate rotational movement of the camshaft lobe into linear movement of the high-pressure fuel pump assembly.

The high-pressure fuel pump assembly is typically operatively attached to the housing, such as with removable fasteners. The housing may be formed as a discrete component or realized as a part of the cylinder head, and includes a tappet cylinder in which the tappet is supported for reciprocating movement.

The tappet typically includes a bearing which engages the lobe of the camshaft, and a body supporting the bearing and disposed force-translating relationship with the high-pressure fuel pump assembly. The high-pressure fuel pump assembly typically includes a spring-loaded piston which is pre-loaded against the tappet body when the high-pressure fuel pump assembly is attached to the housing. Thus, rotational movement of the lobe of the camshaft moves the tappet along the tappet cylinder of the housing which, in turn, translates force to the piston of the high-pressure fuel pump assembly so as to pressurize fuel. As the lobe of the camshaft continues to rotate, potential energy stored in the spring-loaded piston of the high-pressure fuel pump assembly urges the tappet back down the tappet cylinder so as to ensure engagement between the bearing of the tappet and the lobe of the camshaft.

During engine operation, and particularly at high engine rotational speeds, close tolerance must me maintained between the lobe of the camshaft, the tappet, and the piston of the high-pressure fuel pump assembly. Excessive tolerance may result in poor performance as well as increased wear, which leads to significantly decreased component life. Thus, it will be appreciated that it is important to maintain tolerances between the lobe of the camshaft, the tappet, and the piston of the high-pressure fuel pump assembly under varying engine operating conditions, such as engine rotational speed or operating temperature.

Each of the components of an internal combustion engine high-pressure fuel system of the type described above must cooperate to effectively translate movement from the lobe of the camshaft so as to operate the high-pressure fuel pump assembly at a variety of engine rotational speeds and operating temperatures and, at the same time, maintain correct tolerances so as to ensure proper performance. In addition, each of the components must be designed not only to facilitate improved performance and efficiency, but also so as to reduce the cost and complexity of manufacturing and assembling the fuel system, as well as reduce wear in operation. While internal combustion engine high-pressure fuel systems known in the related art have generally performed well for their intended purpose, there remains a need in the art for a high-pressure fuel system that has superior operational characteristics, and, at the same time, reduces the cost and complexity of manufacturing the components of the system.

SUMMARY OF THE INVENTION

The present invention overcomes the disadvantages in the related art in a tappet assembly for use in translating force between a camshaft lobe and a fuel pump assembly via reciprocal movement within a tappet cylinder having a guide slot. The tappet assembly includes a bearing assembly having a shaft and a bearing rotatably supported by the shaft for engaging the camshaft lobe. The tappet assembly further includes an intermediate element having a first aperture, a shelf for engaging the fuel pump assembly, and a pair of arc-shaped bearing surfaces rotatably engaging the shaft when the bearing engages the camshaft lobe and the shelf engages the fuel pump assembly. The tappet assembly further includes an annular body having a second aperture and at least one stop member abutting the intermediate element so as to align the first aperture with the second aperture. The tappet assembly further includes an anti-rotation clip disposed so as to extend through the first aperture and the second aperture. The anti-rotation clip cooperates with the stop member so as to substantially prevent rotational and axial movement of the intermediate element with respect to the annular body.

In this way, the tappet assembly of the present invention significantly reduces the complexity of manufacturing high-pressure fuel systems. Moreover, the present invention reduces the cost of manufacturing high-pressure fuel systems that have superior operational characteristics, such as improved engine performance, control, and efficiency, as well as reduced vibration, noise generation, engine wear, and packaging size.

BRIEF DESCRIPTION OF THE DRAWINGS

Other objects, features, and advantages of the present invention will be readily appreciated as the same becomes better understood after reading the subsequent description taken in connection with the accompanying drawings wherein.

DETAILED DESCRIPTION OF THE INVENTION

Figure 1:
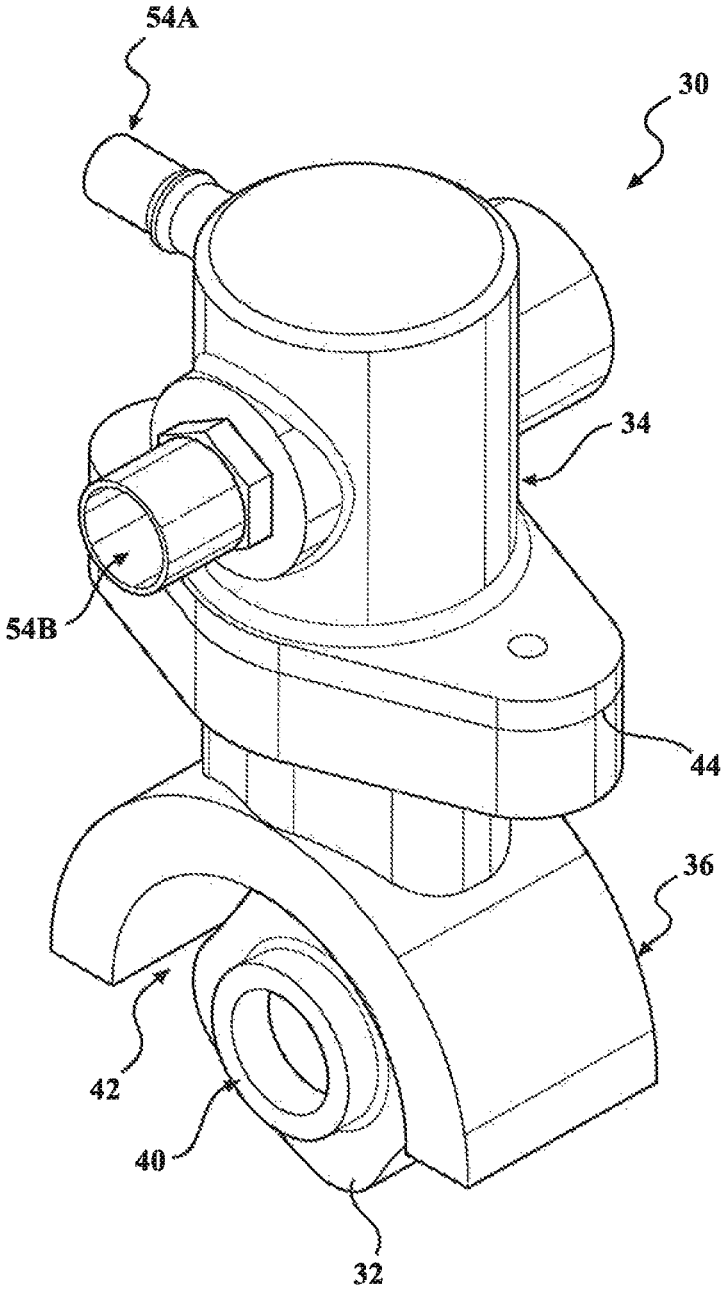
FIG. 1 is a perspective view of high-pressure fuel system showing portions of a fuel pump assembly, a camshaft lobe, and a housing.
Figure 2:
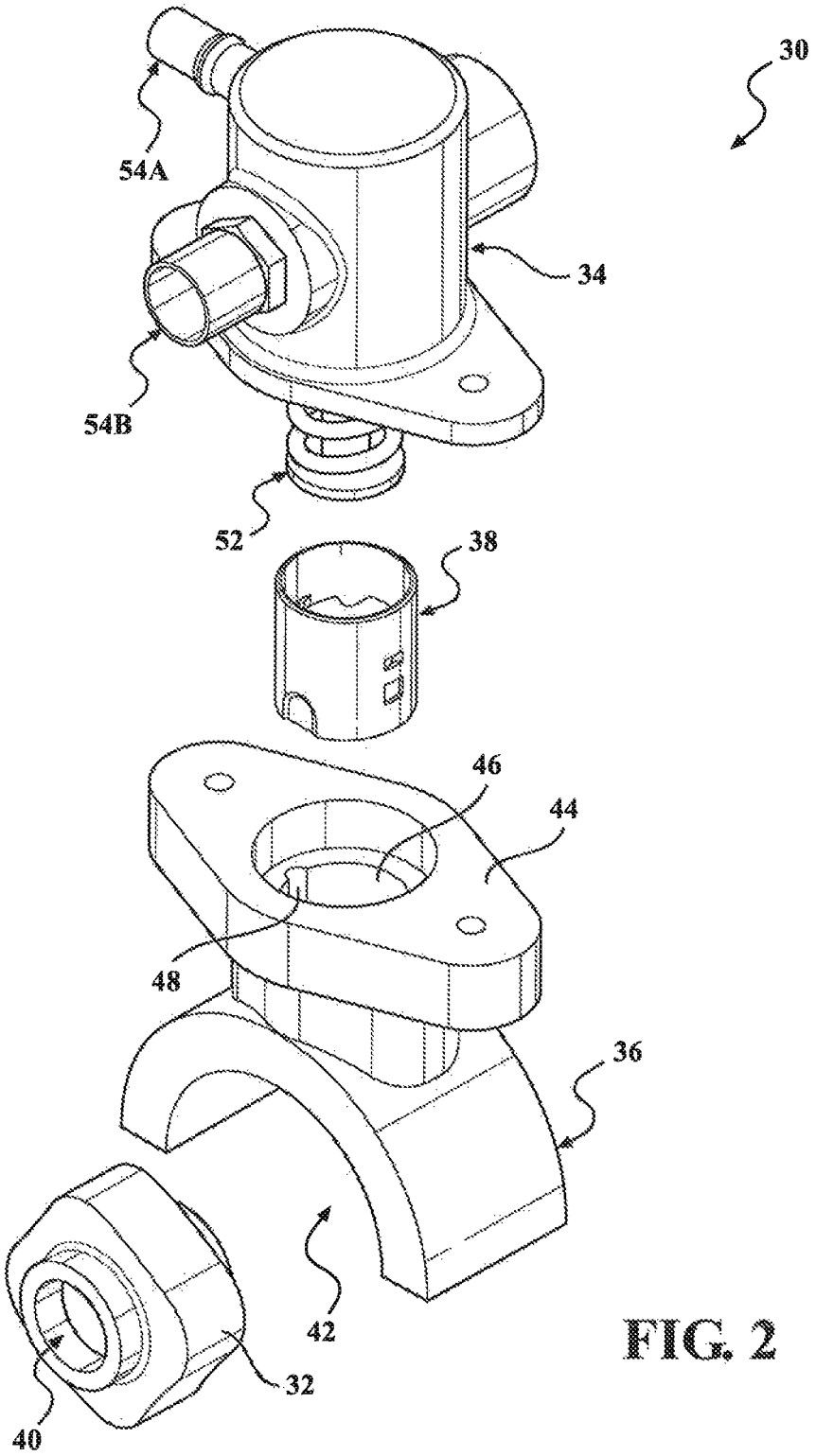
FIG. 2 is an exploded perspective view of the high-pressure fuel system of FIG. 1 showing a tappet assembly according to a first embodiment of the present invention.
Figure 3:
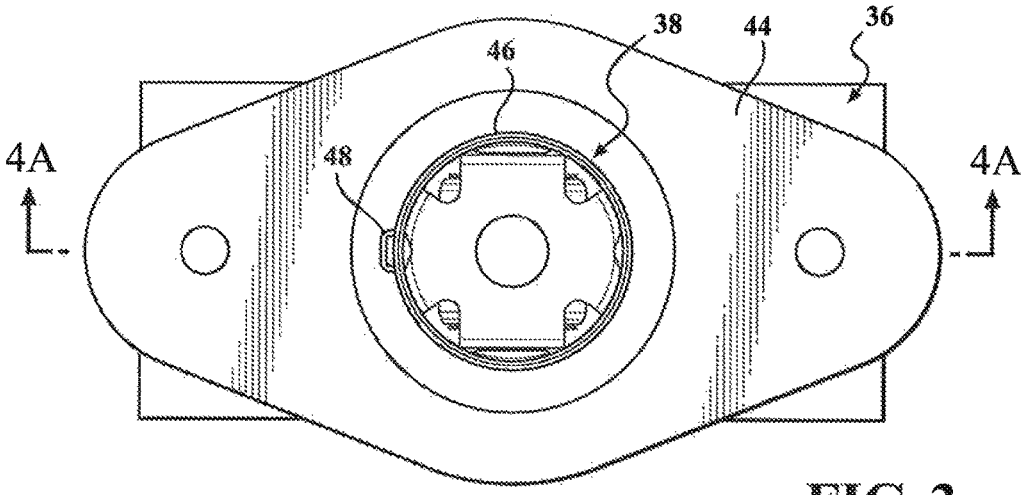
FIG. 3 is a top-side plan view of the housing and tappet assembly of FIG. 2.

Referring now to the drawings, where like numerals are used to designate like structure, a portion of a high-pressure fuel system for an internal combustion engine is illustrated at 30 in FIGS. 1 and 2. The high-pressure fuel system 30 includes a camshaft lobe 32, a high-pressure fuel pump assembly 34, a housing 36, and a tappet assembly according to the present invention and generally indicated at 38. Each of these components will be described in greater detail below.

Figure 4A:
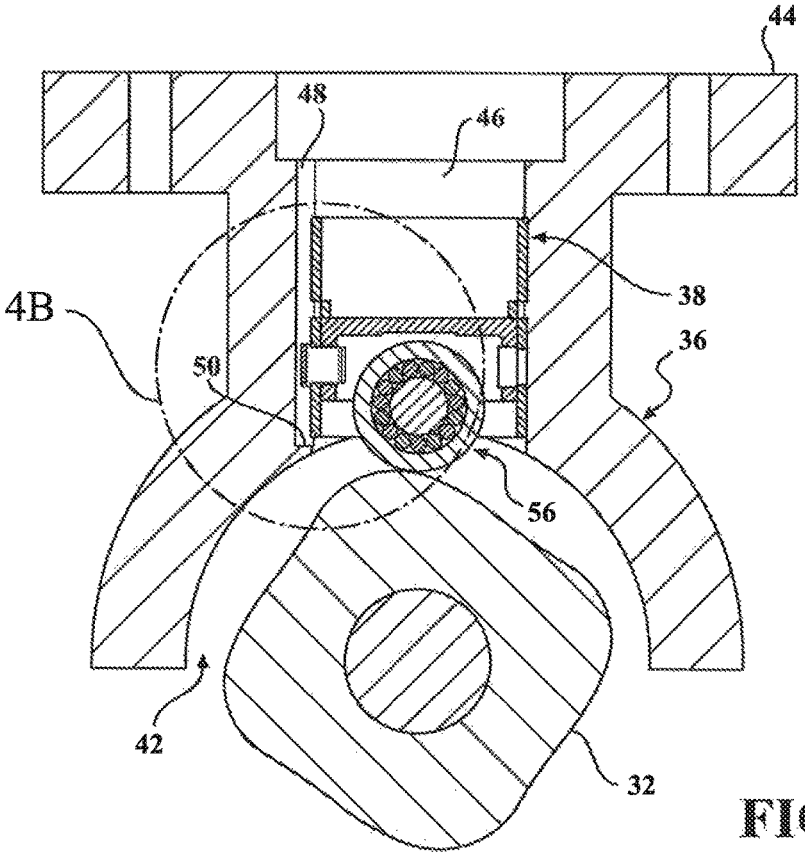
FIG. 4A is a sectional view of the housing, tappet assembly, and camshaft lobe taken along line 4A-4A in FIG. 3.

The camshaft lobe 32 is typically integrated with a camshaft 40 supported in a cylinder head or engine block of an internal combustion engine (not shown, but generally known in the related art). As shown best in FIG. 4A, the camshaft lobe 32 has a generally rectangular profile and is used to drive the high-pressure fuel pump assembly 34, as described in greater detail below. The camshaft lobe 32 is disposed within the housing 36 and rotates within a housing chamber 42 defined by the housing 36.

For the purposes of clarity and consistency, only portions of the camshaft 40, the housing 36, and the housing chamber 42 that are disposed adjacent the camshaft lobe 32 are illustrated herein. Thus, it will be appreciated that the camshaft 40, housing 36, and/or housing chamber 42 could be configured or arranged in a number of different ways sufficient to cooperate with the high-pressure fuel pump assembly 34 without departing from the scope of the present invention. Specifically, the camshaft 40 and camshaft lobe 32 illustrated herein may be integrated with or otherwise form a part of a conventional engine valvetrain system configured to regulate the flow of gasses into and out of the engine (not shown, but generally known in the related art). Moreover, it will be appreciated that the camshaft 40 and/or camshaft lobe 32 could be configured, disposed, or supported in any suitable way sufficient to operate the high-pressure fuel pump assembly 34, without departing from the scope of the present invention. Further, while the camshaft lobe 32 described herein receives rotational torque directly from the engine, those having ordinary skill in the art will appreciate that the camshaft lobe 32 could be disposed in rotational communication with any suitable prime mover sufficient to operate the high-pressure fuel pump assembly 34, without departing from the scope of the present invention.

As noted above, only the portions of the housing 36 and housing chamber 42 adjacent to the camshaft lobe 32 are illustrated throughout the drawings. Those having ordinary skill in the art will appreciated that the housing 36 and housing chamber 42 illustrated in FIGS. 1-4B could be formed or otherwise supported independent of the engine, or could be integrated with any suitable portion of the engine, without departing from the scope of the present invention. The housing 36 includes a flange 44 adapted to releasably secure the high-pressure fuel pump assembly 34, such as with bolts (not shown, but generally known in the related art). The housing 36 also includes a tappet cylinder 46 extending between the housing chamber 42 and flange 44. The tappet assembly 38 is supported for reciprocal movement along the tappet cylinder 46 of the housing 36, as described in greater detail below. The tappet cylinder 46 also includes a guide slot 48 extending between the flange 44 and the housing chamber 42 for indexing the angular position of the tappet assembly 38 with respect to the camshaft lobe 32 and the high-pressure fuel pump assembly 34 (see FIGS. 2-4B). As shown best in FIG. 4A, the guide slot 48 extends to a guide slot end 50 disposed adjacent to and spaced from the housing chamber 42. It will be appreciated that the guide slot end 50 helps prevent the tappet assembly 38 from inadvertently falling into the housing chamber 42 in absence of the camshaft 40.

As shown best in FIG. 2, the high-pressure fuel pump assembly 34 includes a spring-loaded piston, generally indicated at 52, which is pre-loaded against the tappet assembly 38 when the high-pressure fuel pump assembly 34 is attached to the flange 44 of the housing 36.

The high-pressure fuel pump assembly 34 includes a low-pressure port 54A and a high-pressure port 54B. The low-pressure port 54A is typically disposed in fluid communication with a source of fuel such as a fuel tank or a conventional low-pressure fuel system (not shown, but generally known in the related art). Similarly, the high-pressure port 54B is typically disposed in fluid communication with a fuel injector used to facilitate admission of fuel into the engine (not shown, but generally known in the related art). However, those having ordinary skill in the art will appreciate that the high-pressure fuel pump assembly 34 could be configured in any suitable way, with any suitable number of ports, without departing from the scope of the present invention.

Rotational movement of the camshaft lobe 32 moves the tappet assembly 38 reciprocally along the tappet cylinder 46 of the housing 36 which, in turn, translates force to the spring-loaded piston 52 of the high-pressure fuel pump assembly 34 so as to pressurize fuel across the ports 54A, 54B. As the camshaft lobe 32 continues to rotate, potential energy stored in the spring-loaded piston 52 of the high-pressure fuel pump assembly 34 urges the tappet assembly 38 back down the tappet cylinder 46 so as to ensure proper engagement between tappet assembly 38 and the camshaft lobe 32, as described in greater detail below.

Figure 5:
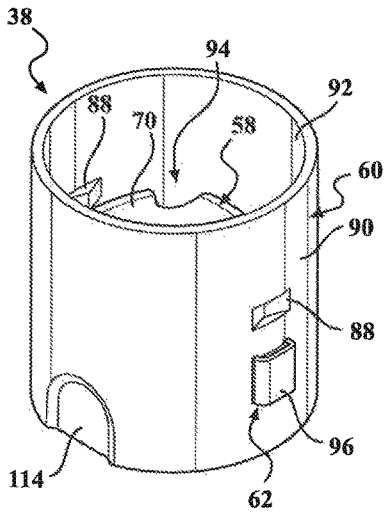
FIG. 5 is a perspective view of the tappet assembly of FIGS. 2-4B.
Figure 6:
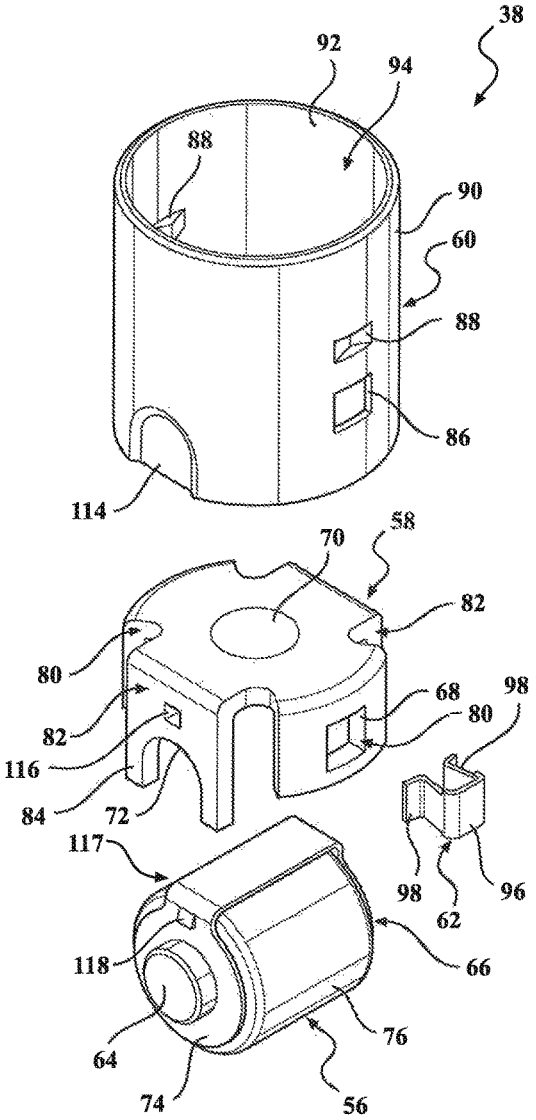
FIG. 6 is a partially exploded perspective view of the tappet assembly of FIG. 5.
Figure 7:
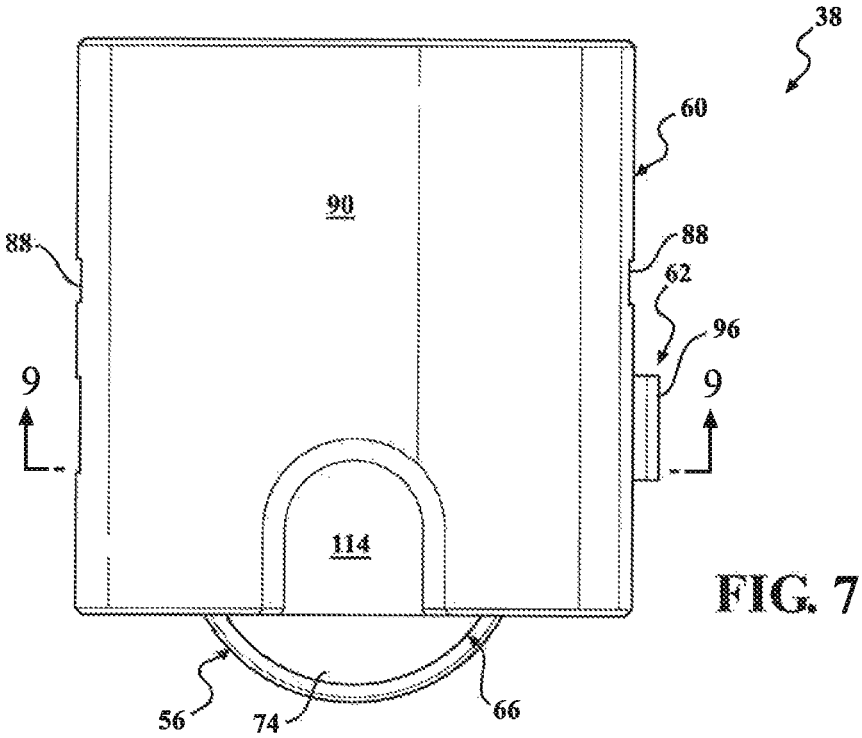
FIG. 7 is a front-side plan view of the tappet assembly of FIG. 5.
Figure 8:
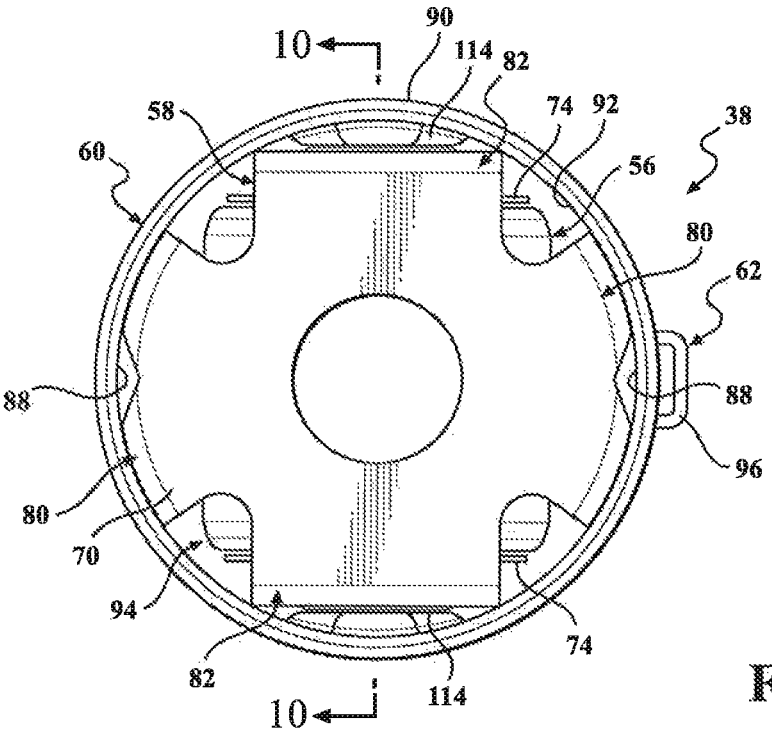
FIG. 8 is a top-side plan view of the tappet assembly of FIG. 5.

Referring now to FIGS. 5 and 6, as noted above, the tappet assembly 38 of the present invention is used to translate force between the camshaft lobe 32 and the high-pressure fuel pump assembly 34. To that end, the tappet assembly 38 includes a bearing assembly 56, an intermediate element 58, an annular body 60, and an anti-rotation clip 62. Each of these components will be described in greater detail below.

It will be appreciated that the tappet assembly 38 of the present invention can configured in a number of different ways depending on the application. By way of non-limiting example, four different embodiments of the tappet assembly 38 of the present invention are described herein. For the purposes of clarity and consistency, unless otherwise indicated, subsequent discussion of the tappet assembly 38 will refer to a first embodiment, as illustrated in FIGS. 2-10.

As shown best in FIG. 6, the bearing assembly 56 of the tappet assembly 38 includes a shaft 64 and a bearing 66 rotatably supported by the shaft 64. The bearing 66 is adapted to engage the camshaft lobe 32 and follows the profile of the camshaft lobe 32 as the camshaft 40 rotates in operation. In one embodiment, the bearing assembly 56 includes a pair of shields 74 supported on the shaft 64 with the bearing 66 interposed between the shields (see FIG. 9). In one embodiment, the bearing 66 of the bearing assembly 56 includes an outer race 76 adapted to engage the camshaft lobe 32, and a plurality of rollers 78 supported between the outer race 76 and the shaft 64 (see FIGS. 4A and 4B). Here, the shields 74 of the bearing assembly 56 cooperate with the intermediate element 58 of the tappet assembly 38 so as to limit axial movement of the rollers 78 and the outer race 76 with respect to the shaft 64. As will be appreciated from the subsequent description below, the bearing assembly 56 can be configured in a number of different ways without departing from the scope of the present invention.

The intermediate element 58 of the tappet assembly 38 includes a first aperture 68, a shelf 70 for engaging the high-pressure fuel pump assembly 34, and a pair of arc-shaped bearing surfaces 72 rotatably engaging the shaft 64 of the bearing assembly 56. Specifically, the arc-shaped bearing surfaces 72 rotatably engage the shaft 64 of the bearing assembly 56 when the bearing 66 of the bearing assembly 56 engages the camshaft lobe 32 and the shelf 70 engages the high-pressure fuel pump assembly 34, as described in greater detail below. As illustrated throughout the drawings, in one embodiment, the intermediate element 58 includes a retention member 80 depending from the shelf 70 with the first aperture 68 extending through the retention member 80. Similarly, in one embodiment, the intermediate element 58 includes a pair of lower members 82 depending from the shelf 70. The lower members 82 each have an outwardly-opening U-shaped portion 84 defining one of the arc-shaped bearing surfaces 72. However, those having ordinary skill in the art will appreciate that the intermediate element 58 could be configured in any suitable way sufficient to engage the high-pressure fuel pump assembly 34 and rotatably engaging the shaft 64 of the bearing assembly 56, as noted above, without departing from the scope of the present invention. In order to facilitate ease of assembly of the tappet assembly 38 during manufacturing, the intermediate element 58 may have a symmetrical profile with a pair of retention members 80 interposed between the pair of lower members 82 (see FIG. 8). In the embodiments illustrated throughout the figures, the intermediate element 58 is formed as a unitary, one-piece component. More specifically, the intermediate element 58 is manufactured from a single piece of sheet steel that is stamped and bent to shape The annular body 60 of the tappet assembly 38 includes a second aperture 86 and at least one stop member 88 abutting the intermediate element 58 so as to align the first aperture 68 of the intermediate element 58 with the second aperture 86 of the annular body 60. In one embodiment, the annular body 60 has an outer surface 90 and an inner surface 92 with the second aperture 86 extending therebetween. Here, the inner surface 92 of the annular body 60 defines a chamber 94 with the stop member 86 extending from the inner surface 92 at least partially into the chamber 94. In the representative embodiments illustrated throughout the drawings, the annular body 60 includes a pair of stop members 88 extending from the inner surface 92 into the chamber 94 and abutting the shelf 70 of the intermediate element 58 (see FIG. 4A). Here, the stop members 88 are realized as indentations formed from the outer surface 90 of the annular body 60, created such as by a stamping process. However, those having ordinary skill in the art will appreciate that the stop members 88 could be formed or otherwise configured in any suitable way sufficient to cooperate with the intermediate element 58, as noted above, without departing from the scope of the present invention. In the embodiments illustrated throughout the figures, the annular body 60 is formed as a unitary, one-piece component, manufactured such as from steel. It will be appreciated that the stop members 88 and the shelf 70 facilitate simple and cost-effective axial alignment between the body 60 and the intermediate element 58 without necessitating complex machining or heat treatment procedures.

The anti-rotation clip 62 of the tappet assembly 38 is disposed so as to extend through the first aperture 68 of the intermediate element 58 and the second aperture 86 of the annular body 60. The anti-rotation clip 62 cooperates with the stop member 88 of the annular body 60 so as to substantially prevent rotational and axial movement of the intermediate element 58 with respect to the annular body 60 (see FIGS. 4B and 9). In one embodiment, the anti-rotation clip 62 of the tappet assembly 38 has a guide portion 96 and a pair of legs 98 extending from the guide portion 96. The guide portion 96 has a substantially C-shaped profile and is configured to engage and travel along the guide slot 48 of the tappet cylinder 46 of the housing 36 so as to index the tappet assembly 38 within the tappet cylinder 46. The legs 98 of the anti-rotation clip 62 extend from the guide portion 96 through the first aperture 68 and the second aperture 86. Thus, the guide portion 96 and the legs 98 of the anti-rotation clip 62 cooperate so as to simultaneously retain the intermediate element 58 to the annular body 60 and align the tappet assembly 62 with the guide slot 48 of the tappet cylinder 46. More specifically, the legs 98 of the anti-rotation clip 62 ensure proper angular and axial alignment of the intermediate element 58 with respect to the body 60, and the guide portion 96 of the anti-rotation clip 62 ensures proper angular alignment of the annular body 60 with respect to the housing 36 which, in turn, ensures that the bearing assembly 56 is properly aligned with the camshaft lobe 32 in operation. In the embodiments illustrated throughout the figures, the anti-rotation clip 62 is formed as a unitary, one-piece component. More specifically, the anti-rotation clip 62 is manufactured from a single piece of bent spring steel. Thus, it will be appreciated that the anti-rotation clip 62 facilitates simple, reliable retention between the intermediate element 58 and the annular body 60. Moreover, it will be appreciated that the cooperation between the anti-rotation clip 62, the apertures 68, 86, and the stop member 88 facilitate alignment and retention of the bearing assembly 56 in a cost-effective way and without necessitating precision machining or complex heat treatment procedures.

Figure 4B:
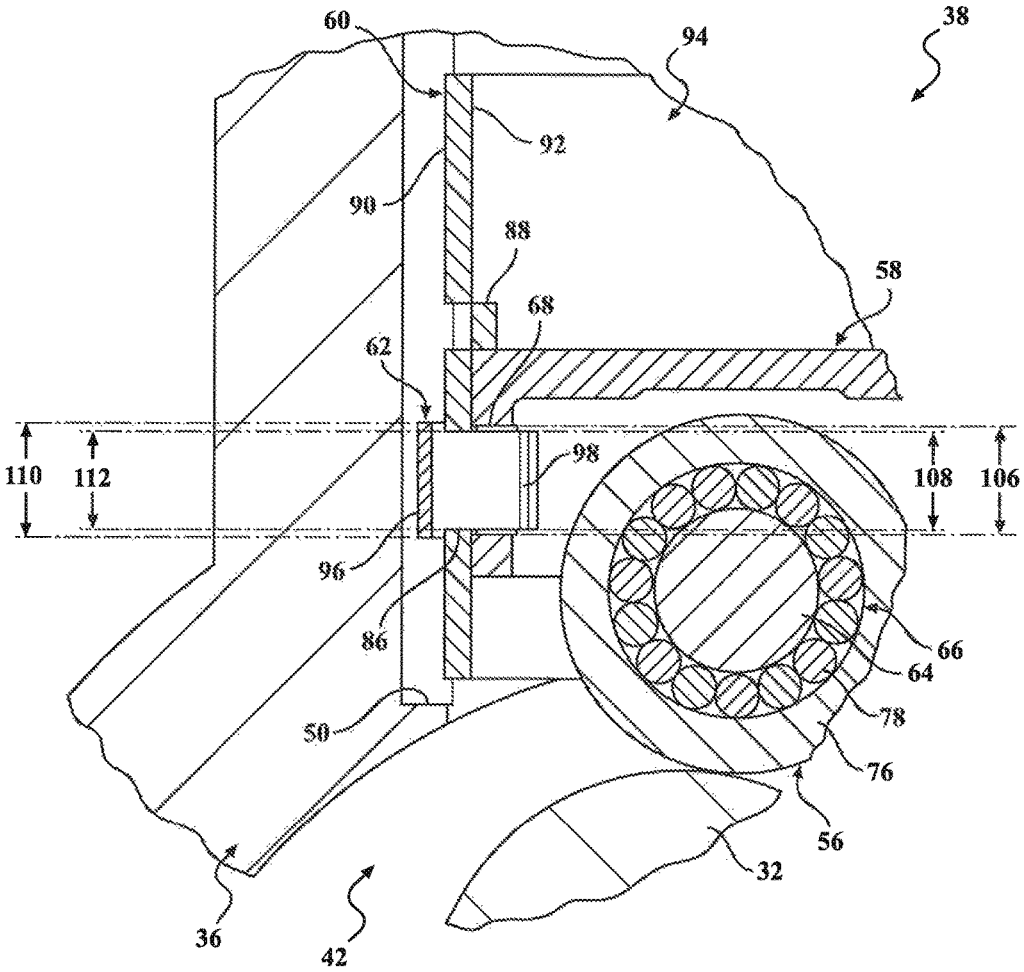
FIG. 4B is an enlarged sectional view taken along indicia 4B-4B in FIG. 4A.
Figure 9:
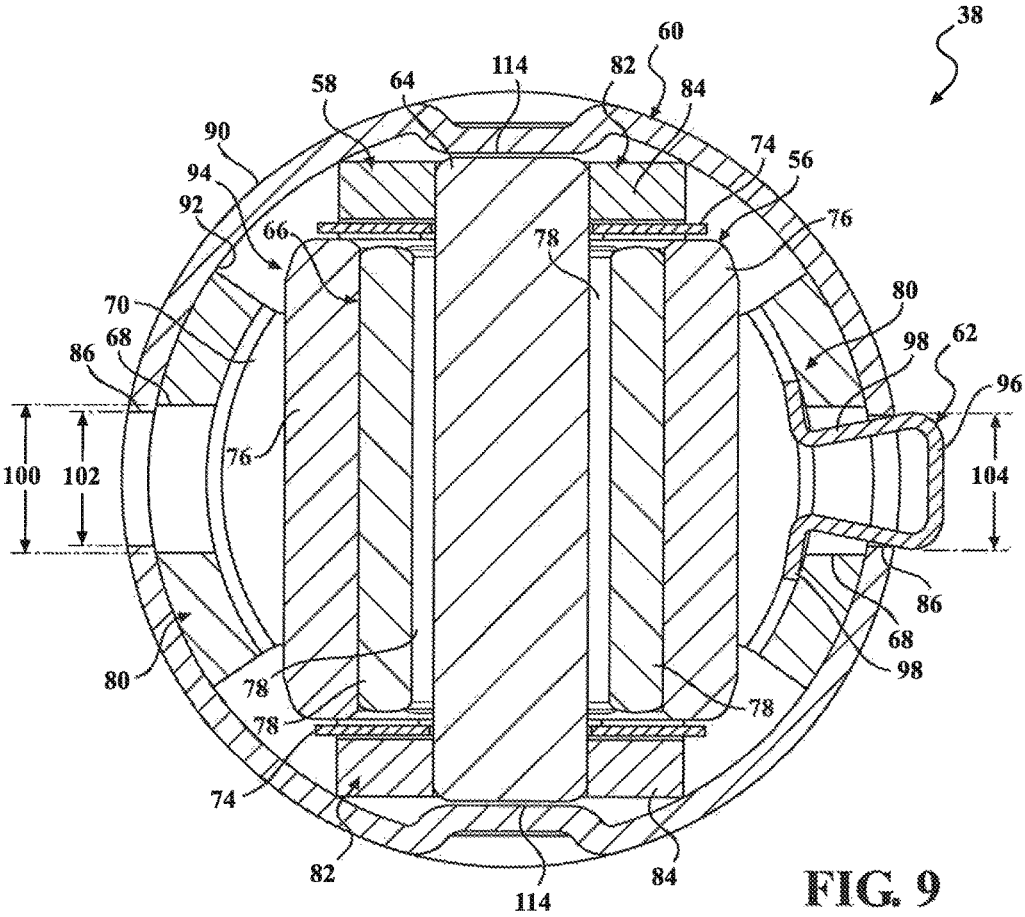
FIG. 9 is a sectional view taken along line 9-9 in FIG. 7.
Figure 10:
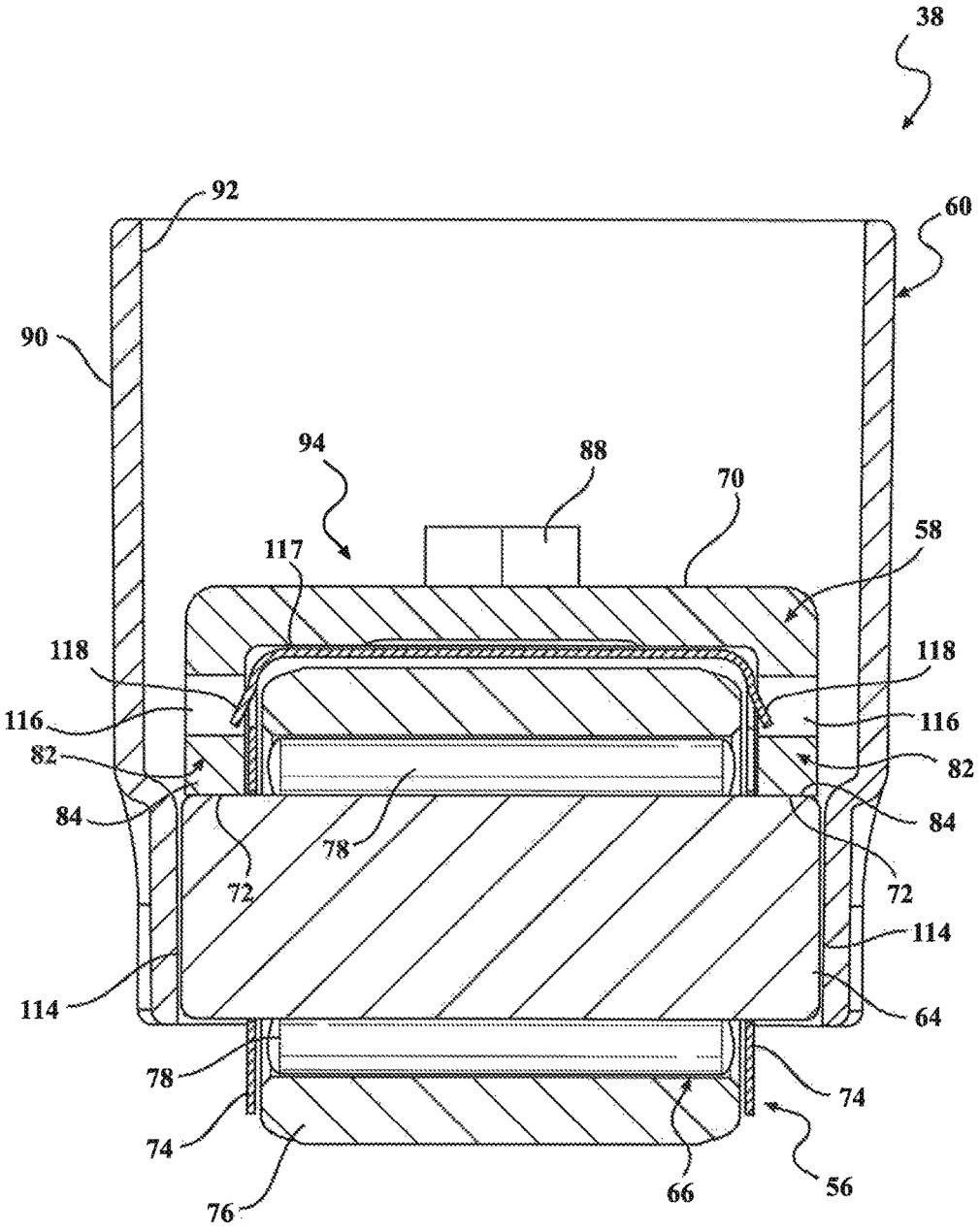
FIG. 10 is a sectional view taken along line 10-10 in FIG. 8.
Figure 11:
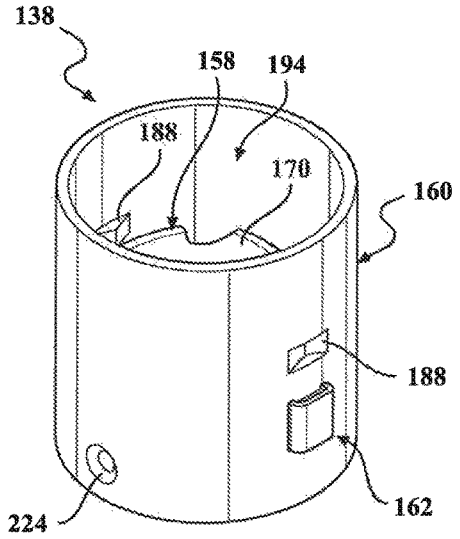
FIG. 11 is a perspective view of the tappet assembly of the present invention according to a second embodiment.
Figure 12:
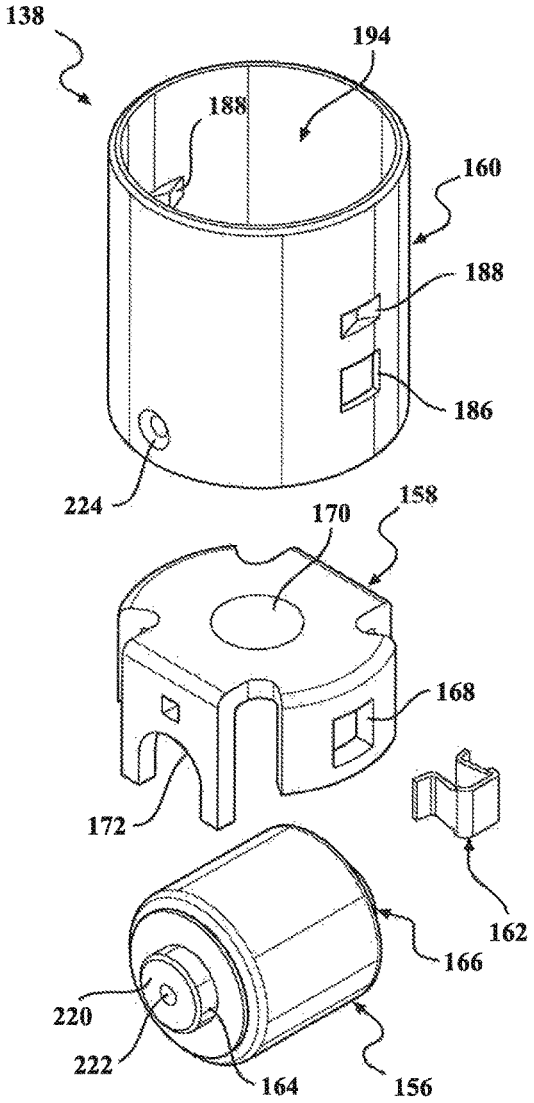
FIG. 12 is a partially exploded perspective view of the tappet assembly of FIG. 11.
Figure 13:
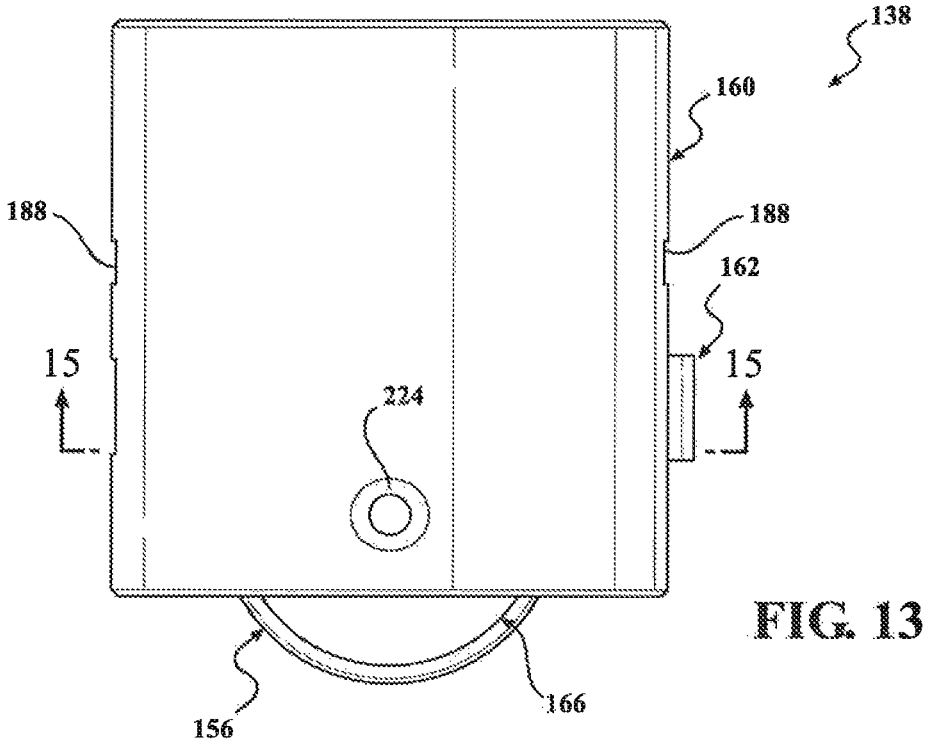
FIG. 13 is a front-side plan view of the tappet assembly of FIG. 11.
Figure 14:
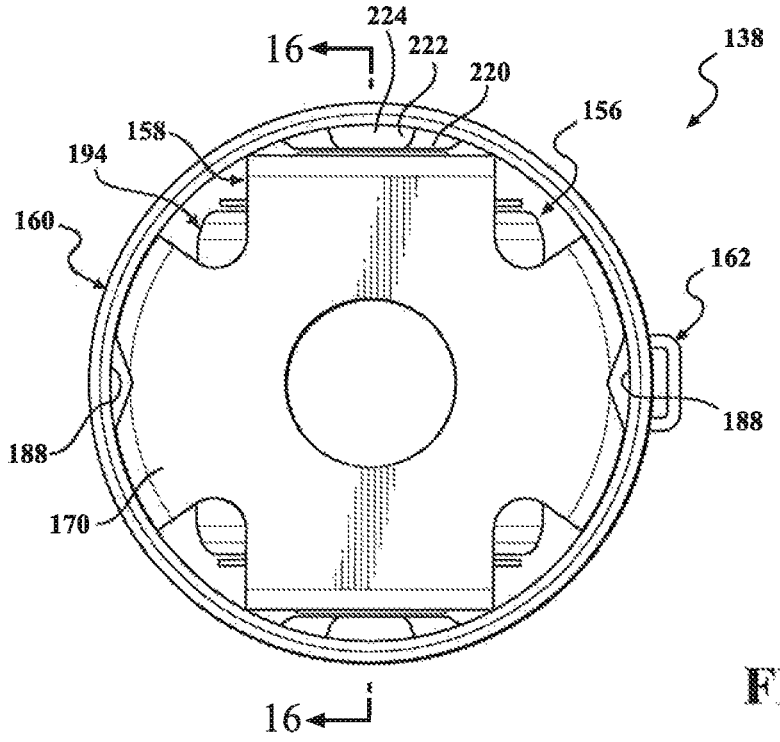
FIG. 14 is a top-side plan view of the tappet assembly of FIG. 11.
Figure 15:
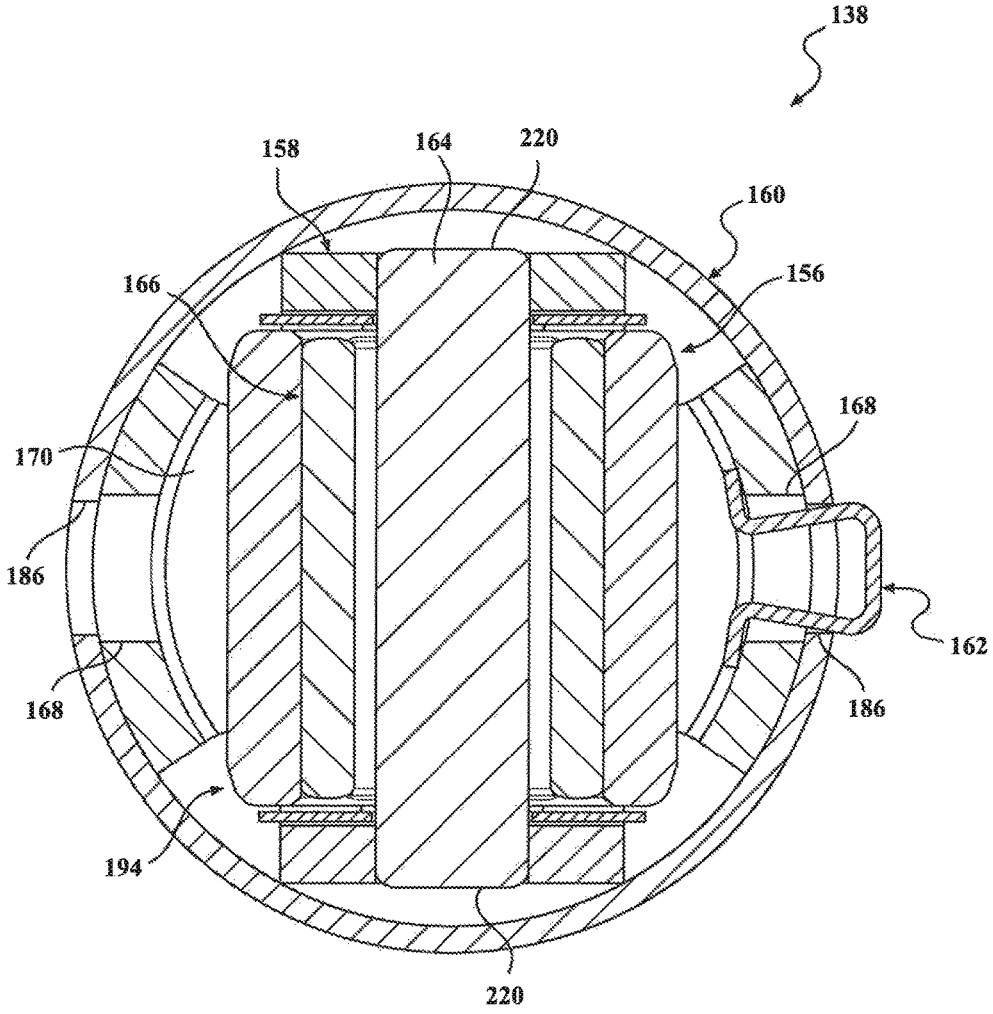
FIG. 15 is a sectional view taken along line 15-15 in FIG. 13.

As shown in FIG. 9, in one embodiment, the first aperture 68 of the intermediate element 58 has a first aperture width 100, the second aperture 86 of the annular body 60 has a second aperture width 102, and the guide portion 96 of the anti-rotation clip 62 has a guide width 104. The guide width 104 is greater than the second aperture width 102. Similarly, the first aperture width 100 is greater than the second aperture width 102. Similarly, as shown in FIG. 4B, in one embodiment, the first aperture 68 of the intermediate element 58 has a first aperture height 106, the second aperture 86 of the annular body 60 has a second aperture height 108, the guide portion 96 of the anti-rotation clip 62 has a guide height 110, and the legs 98 of the anti-rotation clip 62 have a leg height 112. The guide height 110 is greater than the second aperture height 108. Similarly, the first aperture height 106 is greater than the second aperture height 108. In one embodiment, the leg height 112 is substantially equal to the second aperture height 108 of the annular body 60. The aforementioned height and width relationships help optimize retention between the annular body 60 and the intermediate element 58 and help facilitate ease of assembly of the tappet assembly 38 during manufacturing.

When the tappet assembly 38 is installed into the tappet cylinder 46 of the housing 36 and the high-pressure fuel pump assembly 34 is operatively attached to the flange 44 of the housing 36, the spring-loaded piston 52 engages against the shelf 70 of the intermediate element 58 and the bearing assembly 56 engages the camshaft lobe 32. Here, a certain amount of pre-load force from the spring-loaded piston 52 is exerted against the intermediate element 58 which, in turn, pushes the shaft 64 of the bearing assembly 56 against the arc-shaped bearing surfaces 72 of the intermediate element 58 in response to engagement between the camshaft lobe 32 and the bearing 66 of the bearing assembly 56.

It will be appreciated that the angular and axial alignment afforded by the cooperation of the intermediate element 58, the annular body 60, and the anti-rotation clip 62 also help align the bearing assembly 56 with respect the annular body 60 so as to ensure proper alignment of the bearing assembly 56 with the camshaft lobe 32 in operation. Moreover, as described in greater detail below, the intermediate element 58 and/or the annular body 60 can be configured in a number of different ways so as to ensure proper retention and axial alignment of the bearing assembly 56 with respect to the annular body 60.

In the first embodiment of the tappet assembly 38 of the present invention illustrated in FIGS. 2-10, the annular body 60 includes a pair of lower walls 114 disposed adjacent to the shaft 64 of the bearing assembly 56. Here, the lower walls 114 are spaced from each other so as to limit axial movement of the shaft 64 in operation (see FIGS. 7, 9, and 10). The lower walls 114 are realized as indentations formed from the outer surface 90 of the annular body 60, created such as by a stamping process. As shown best in FIGS. 6 and 10, the intermediate element 58 may include a pair of lock apertures 116 for facilitating retention of the bearing assembly 56, as described in greater detail below. The lock apertures 116 are formed in the lower members 82 of the intermediate element 58, spaced between the shelf 70 and the u-shaped portions 84. Here, the bearing assembly 56 further includes a saddle 117 extending between the shields 74 over the bearing 66 (see FIGS. 6 and 10). The saddle 117 includes a pair of opposing fingers 118 for engaging in the lock apertures 116 so as to substantially retain the bearing assembly 56 to the intermediate element 58 and so as to substantially retain the shaft 64 of the bearing assembly 56 within the annular body 60 in absence of engagement between the bearing 66 and the camshaft lobe 32.

As noted above, a second embodiment of the tappet assembly 38 of the present invention is shown in FIGS. 11-16. While specific differences between the embodiments will be described in greater detail below, in the description that follows, like components and structure of the second embodiment of the tappet assembly 38 are provided with the same reference numerals used in connection with the first embodiment increased by 100.

Referring now to FIGS. 11-16, the second embodiment of the tappet assembly 138 of the present invention is shown. In this embodiment, the annular body 160 is adapted to limit axial movement of the shaft 164 of the bearing assembly 156 as well as substantially retain the shaft 164 within the chamber 194 in absence of engagement between the bearing 166 and the camshaft lobe 32, rather than the intermediate element 158 retaining the shaft 164 as described above in connection with the first embodiment. More specifically, in the second embodiment, the shaft 164 of the bearing assembly 156 extends between shaft ends 220 with a dimple 222 defined in each of the shaft ends 220 (see FIGS. 12 and 16). Here, the annular body 160 includes a pair of inwardly-protruding retention elements 224 spaced from each other so as to limit axial movement of the shaft 164. The retention elements 224 protrude into the chamber 194 and cooperate with the dimples 222 so as to retain the shaft 164 of the bearing assembly 156 within the annular body 160 in absence of engagement between the bearing 166 and the camshaft lobe 32. Further, the stop members 188 of the annular body 160 abut the shelf 170 of the intermediate element 158 and align the first aperture 168 with the second aperture 186, as described in greater detail above in connection with the first embodiment. Once the tappet assembly 138 is installed, as described above, the shaft 164 is rotatably supported by the arc-shaped bearing surfaces 172. Thus, the intermediate element 158, the annular body 160, and the anti-rotation clip 162 cooperate so as to simultaneously facilitate proper alignment of the components of the tappet assembly 138 and secure the bearing assembly 156.

Figure 16:
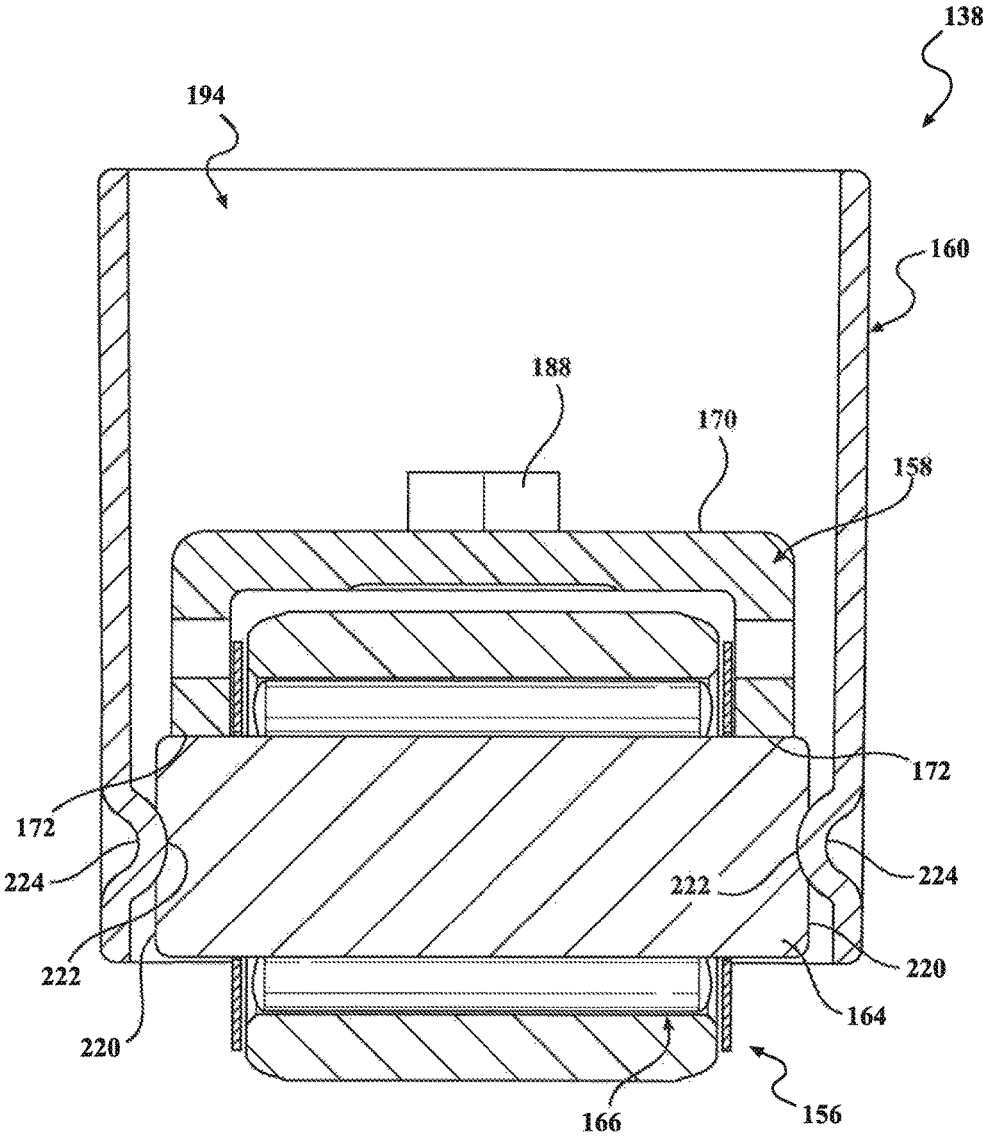
FIG. 16 is a sectional view taken along line 16-16 in FIG. 14.
Figure 17:
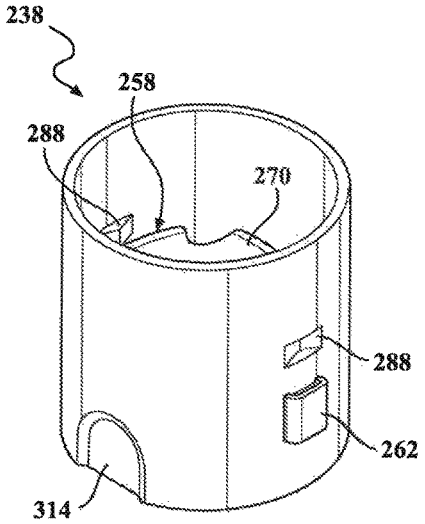
FIG. 17 is a perspective view of the tappet assembly of the present invention according to a third embodiment.
Figure 18:
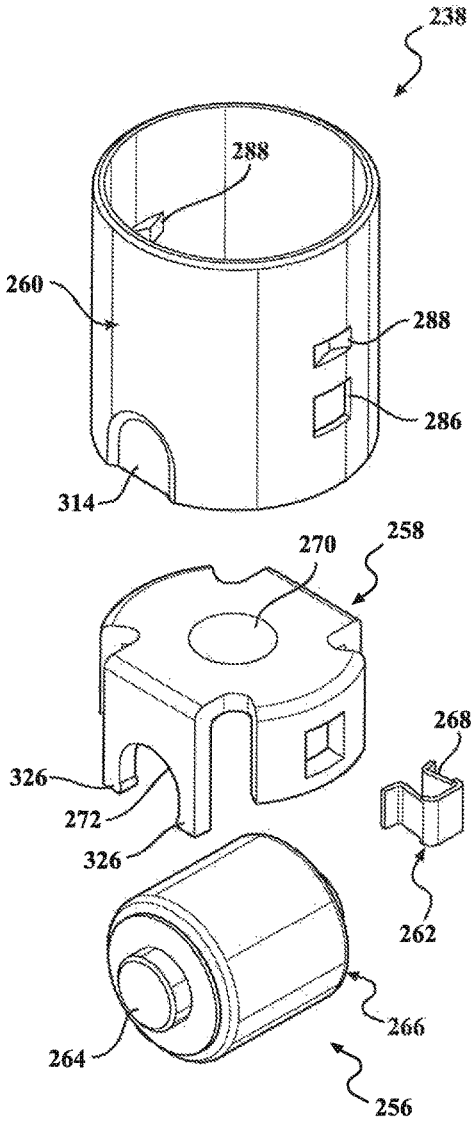
FIG. 18 is a partially exploded perspective view of the tappet assembly of FIG. 17.
Figure 19:
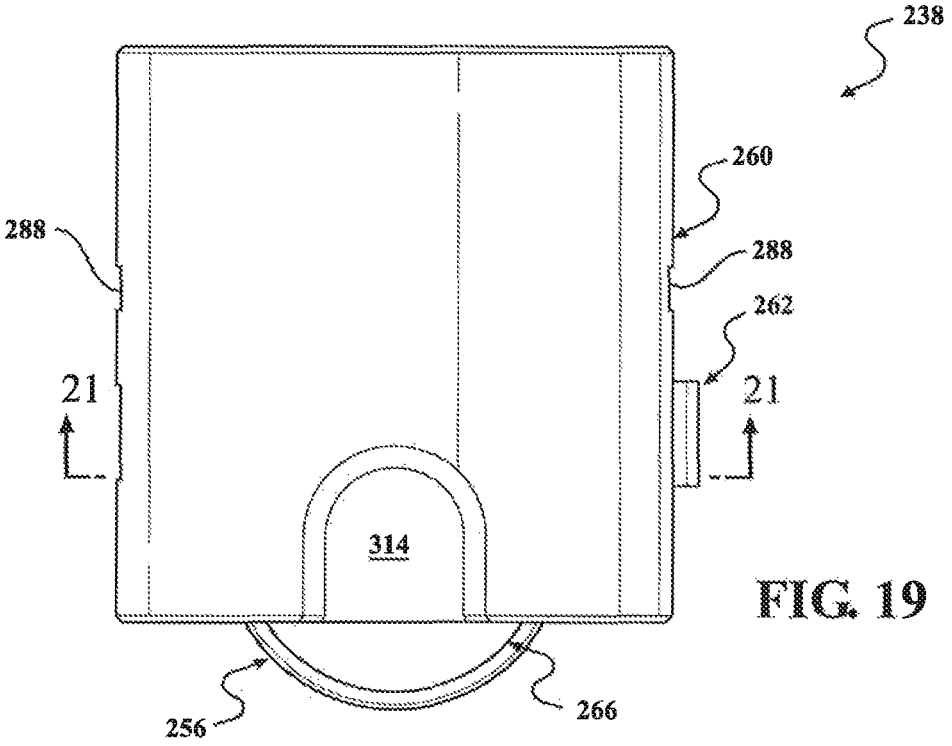
FIG. 19 is a front-side plan view of the tappet assembly of FIG. 17.
Figure 20:
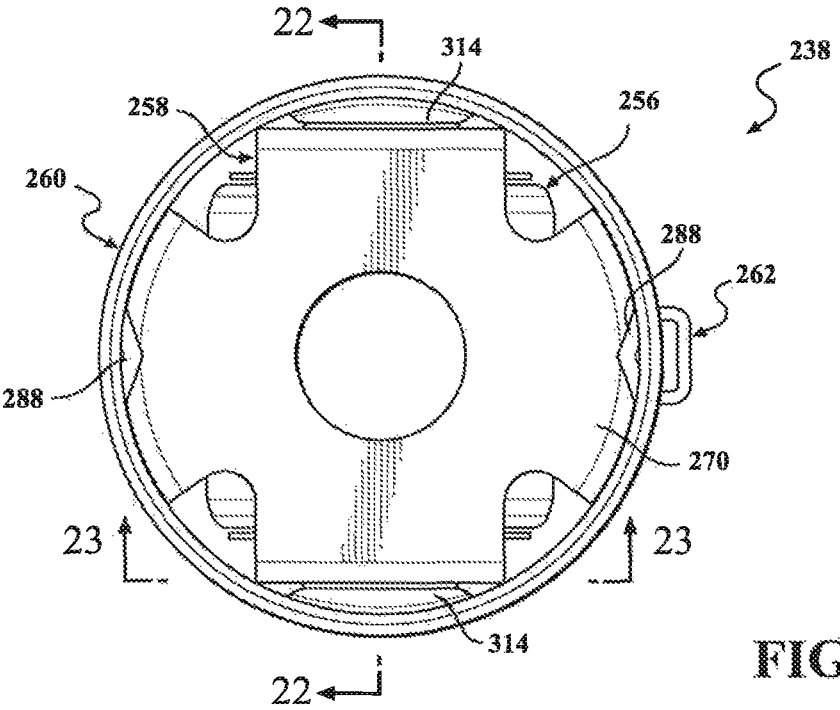
FIG. 20 is a top-side plan view of the tappet assembly of FIG. 17.
Figure 21:
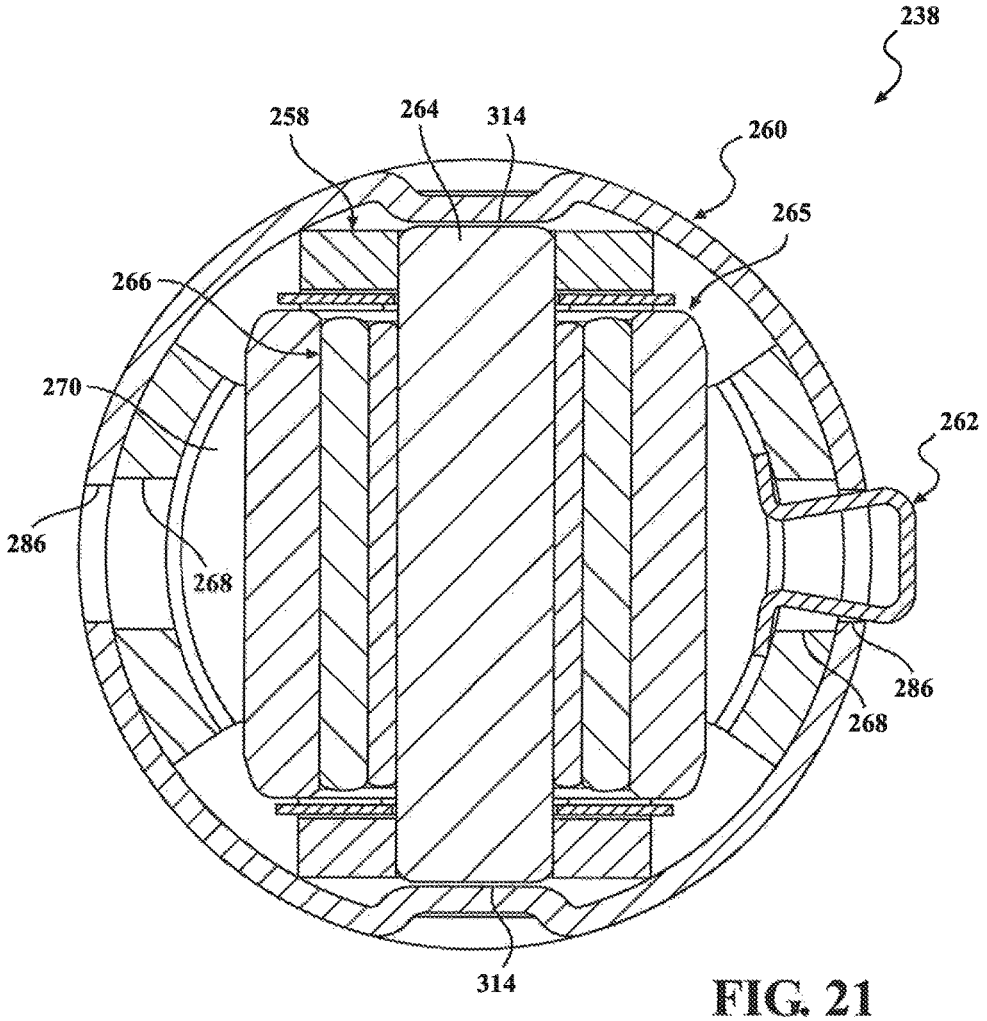
FIG. 21 is a sectional view taken along line 21-21 in FIG. 19.
Figure 22:
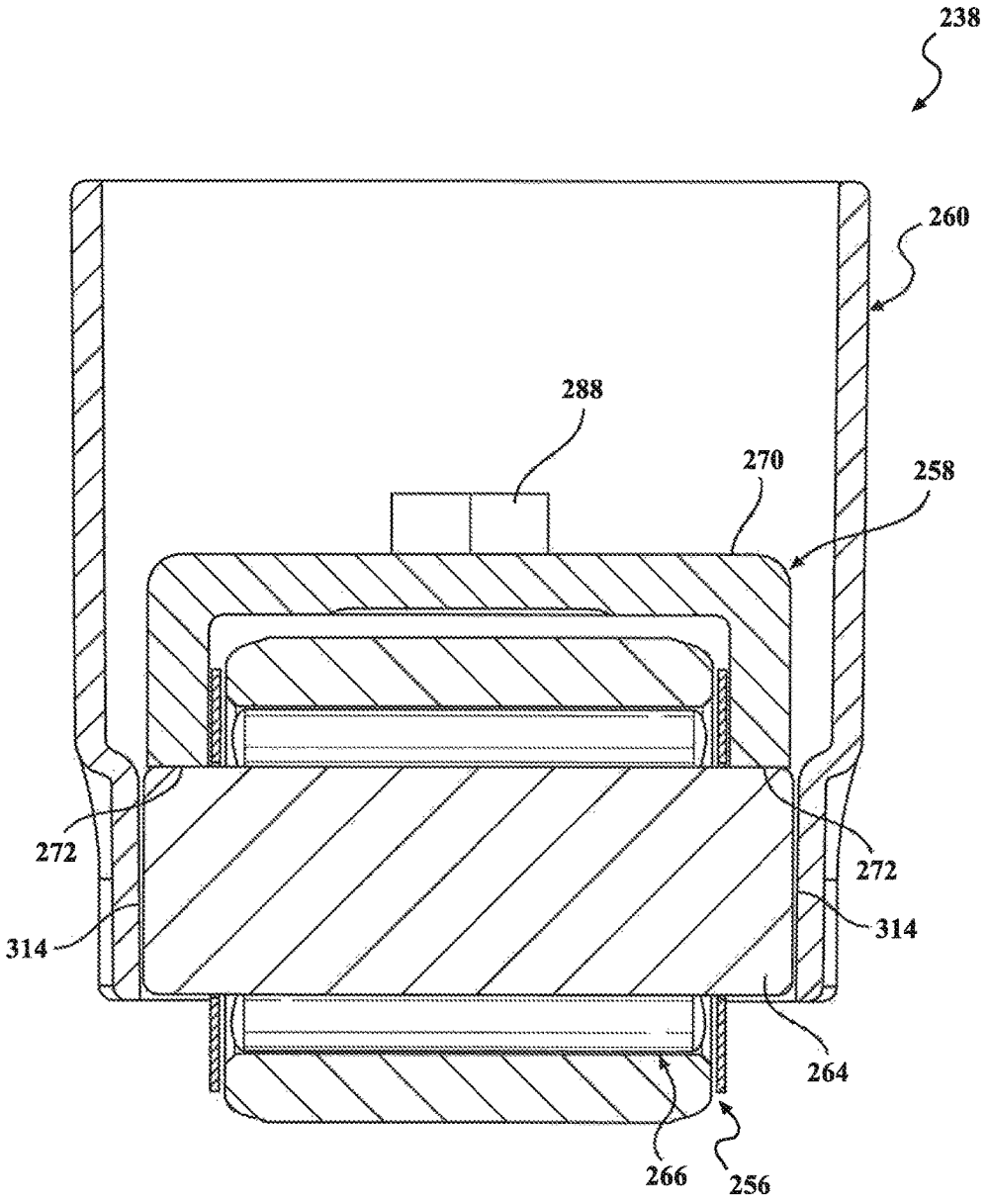
FIG. 22 is a sectional view taken along line 22-22 in FIG. 20.
Figure 23:
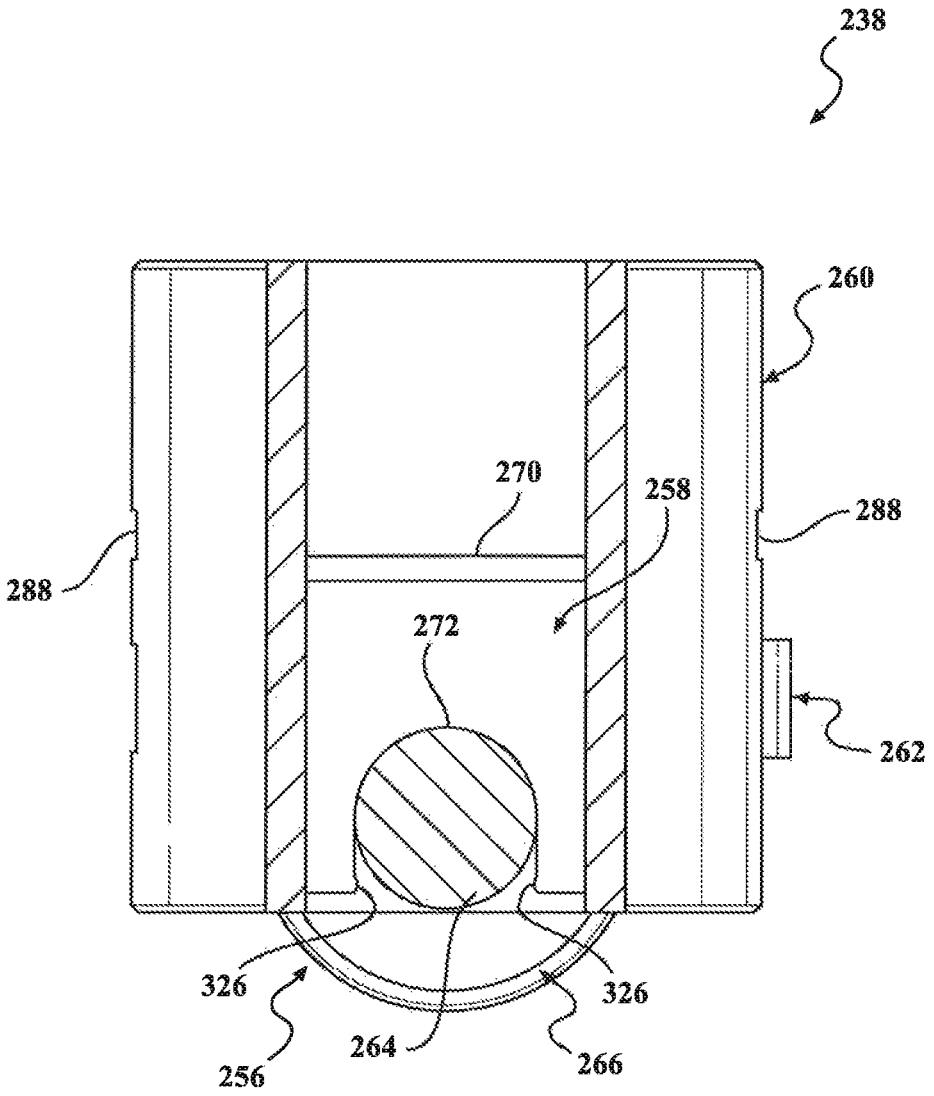
FIG. 23 is a sectional view taken along line 23-23 in FIG. 20.
Figure 24:
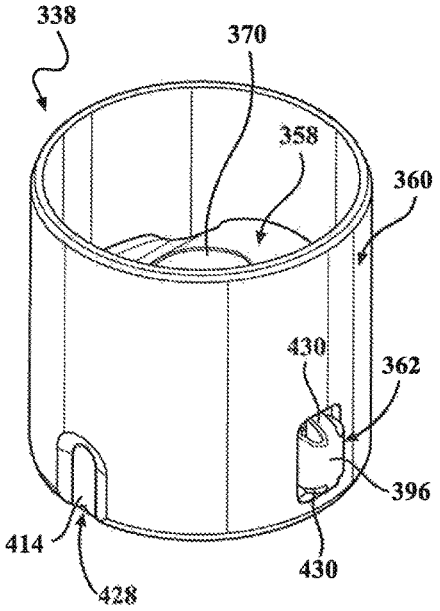
FIG. 24 is perspective view of the tappet assembly of the present invention according to a fourth embodiment.

As shown best in FIG. 16, in one embodiment, the dimples 222 are substantially concentrically aligned with the shaft 164 and have a substantially concave profile. Likewise, the retention elements 224 of the annular body 160 have a substantially convex profile. However, those having ordinary skill in the art will appreciate that the dimples 222 and/or the retention elements 224 could have any suitable profile or configuration without departing from the scope of the present invention.

As noted above, a third embodiment of the tappet assembly 38 of the present invention is shown in FIGS. 17-23. While specific differences between the embodiments will be described in greater detail below, in the description that follows, like components and structure of the third embodiment of the tappet assembly 38 are provided with the same reference numerals used in connection with the first embodiment increased by 200.

Referring now to FIGS. 17-23, the third embodiment of the tappet assembly 238 of the present invention is shown. In this embodiment, the annular body 260 includes a pair of lower walls 314 disposed adjacent to the shaft 264 of the bearing assembly 256. Here, like in the first embodiment of the tappet assembly 38 described above, the lower walls 314 are spaced from each other so as to limit axial movement of the shaft 264 in operation (see FIGS. 19, 21, and 22). Here, the intermediate element 258 includes a pair of hooks 326 disposed in spaced relation below each of the arc-shaped bearing surfaces 272 (see FIG. 23) so as to substantially retain the shaft 264 of the bearing assembly 256 within the annular body 260 in absence of engagement between the bearing 266 and the camshaft lobe 32, as discussed in greater detail above in connection with the first embodiment. Further, the stop members 288 of the annular body 260 abut the shelf 270 of the intermediate element 258 and align the first aperture 268 with the second aperture 286, as described in greater detail above in connection with the first embodiment. Once the tappet assembly 238 is installed, as described above, the shaft 264 is rotatably supported by the arc-shaped bearing surfaces 272. Thus, the intermediate element 258, the annular body 260, and the anti-rotation clip 262 cooperate so as to simultaneously facilitate proper alignment of the components of the tappet assembly 238 and secure the bearing assembly 256.

As noted above, a fourth embodiment of the tappet assembly 38 of the present invention is shown in FIGS. 24-28C. While specific differences between the embodiments will be described in greater detail below, in the description that follows, like components and structure of the fourth embodiment of the tappet assembly 38 are provided with the same reference numerals used in connection with the first embodiment increased by 300.

Referring now to FIGS. 24-28C, the fourth embodiment of the tappet assembly 338 of the present invention is shown. In this embodiment, the annular body 360 includes a pair of lower walls 414 disposed adjacent to the shaft 364 of the bearing assembly 356. Here too, the lower walls 414 are spaced from each other so as to limit axial movement of the shaft 264 in operation (see FIGS. 26, 28A, and 28B). In this fourth embodiment of the tappet assembly 338, each of the lower walls 414 includes a respective brace 428 formed and arranged so as to substantially retain the shaft 364 of the bearing assembly 356 within the annular body 360 in absence of engagement between the bearing 366 and the camshaft lobe 32, as discussed in greater detail above in connection with the first embodiment. As is best shown in FIG. 28B, the braces 428 face towards each other and are arranged so as to be disposed below the arc-shaped bearing surfaces 372 when the tappet assembly 338 is in use. Once the tappet assembly 338 is installed, as described above, the shaft 364 is rotatably supported by the arc-shaped bearing surfaces 372. Thus, the intermediate element 358, the annular body 360, and the anti-rotation clip 362 cooperate so as to simultaneously facilitate proper alignment of the components of the tappet assembly 338 and secure the bearing assembly 356.

As is best shown in FIG. 25, in this fourth embodiment of the tappet assembly 338, the intermediate element 358 has a more rounded configuration when compared to the intermediate 58 of the first embodiment described above (compare FIGS. 6 and 25). Specifically, the shelf 370, the retention members 380, and the lower members 384 each have a chamfered profile, and the shelf 370 merges smoothly with the retention members 380 and the lower members 384 so as to promote reduced stress concentration.

Figure 25:
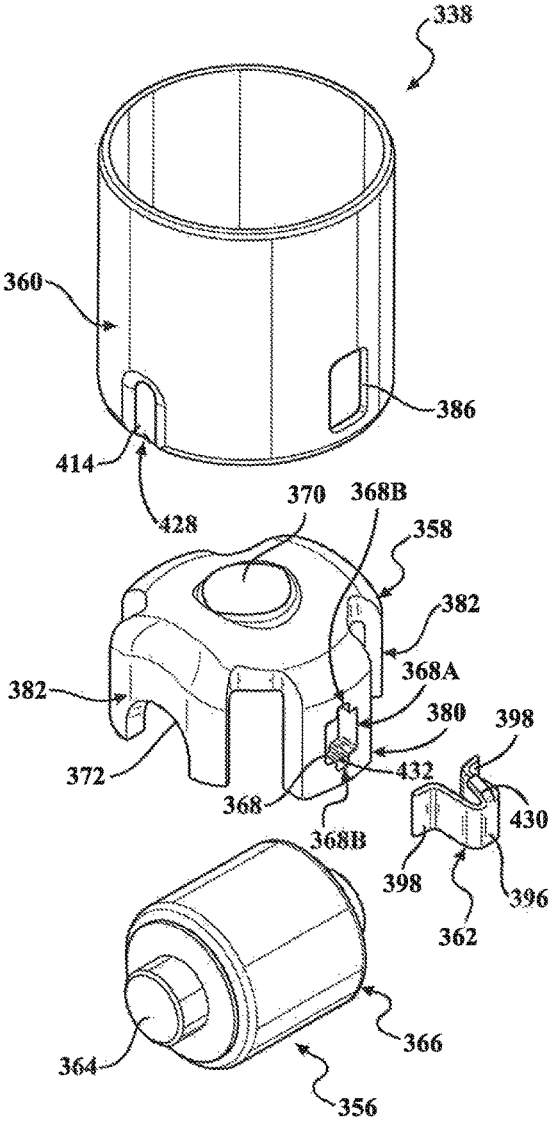
FIG. 25 is a partially exploded perspective view of the tappet assembly of FIG. 24.
Figure 26:
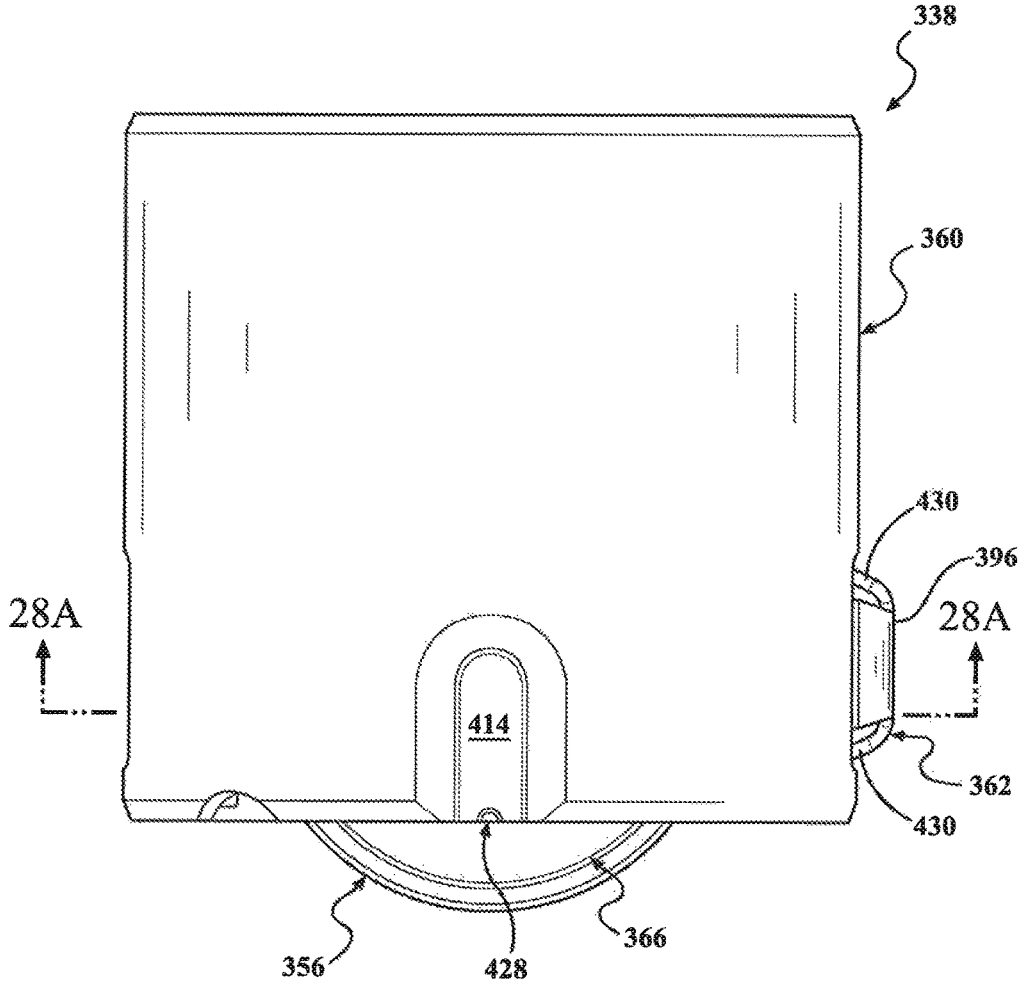
FIG. 26 is a front-side plan view of the tappet assembly of FIG. 24.
Figure 27:
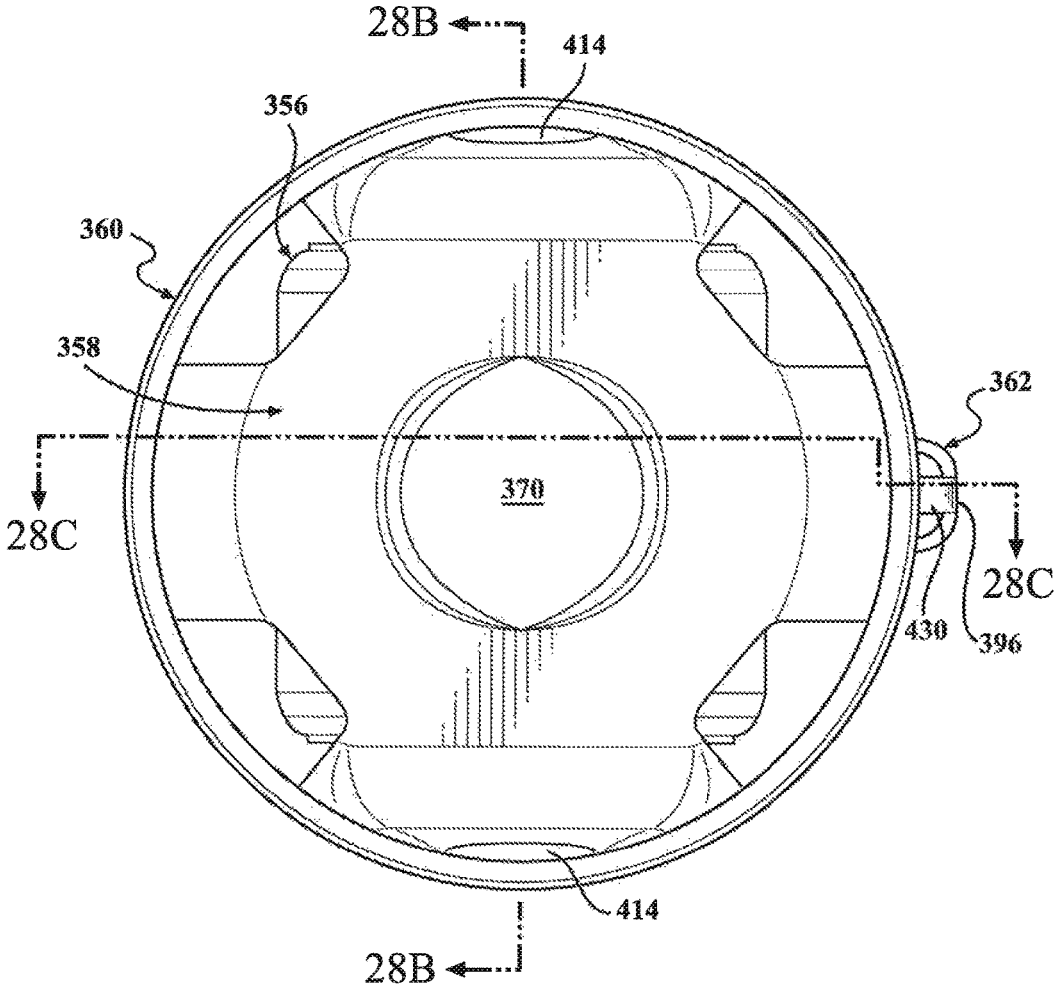
FIG. 27 is a top-side plan view of the tappet assembly of FIG. 24.

As is shown best in FIG. 25, the second aperture 386 formed in the annular body 360 has a generally rounded-rectangular profile. However, in this fourth embodiment of the tappet assembly 338, the first aperture 368 formed in the retention member 380 is defined by a generally rectangular central region 368A and a pair of extension regions 368B in communication with the central region 368A and spaced vertically from each other so as to give the first aperture 368 a substantially "elongated plus-shaped" profile. Here, the shape of the first aperture 368 is complimentary to the configuration of the forth embodiment of the anti-rotation clip 362. In this fourth embodiment, the anti-rotation clip 362 similarly has the guide portion 396 and legs 398 extending therefrom. However, in this embodiment, the anti-rotation clip 362 further includes a pair of projections 430 extending from the guide portion 396 interposed between the legs 398. As is best shown in FIG. 25, the projections 430 extend from the guide portion 396 in the same direction as the legs 98, and are spaced so as to respectively engage at least partially within one of the extension regions 368B of the first aperture 368. Specifically, as is shown in FIG. 28C, the projections 430 abut angled engagement surfaces 432 arranged within the extension regions 368B. Here, it will be appreciated that the second aperture 386 formed in the annular body 360 is shaped to accommodate the projections 430 in use (see FIGS. 24, 28A, and 28C).

Figure 28A:
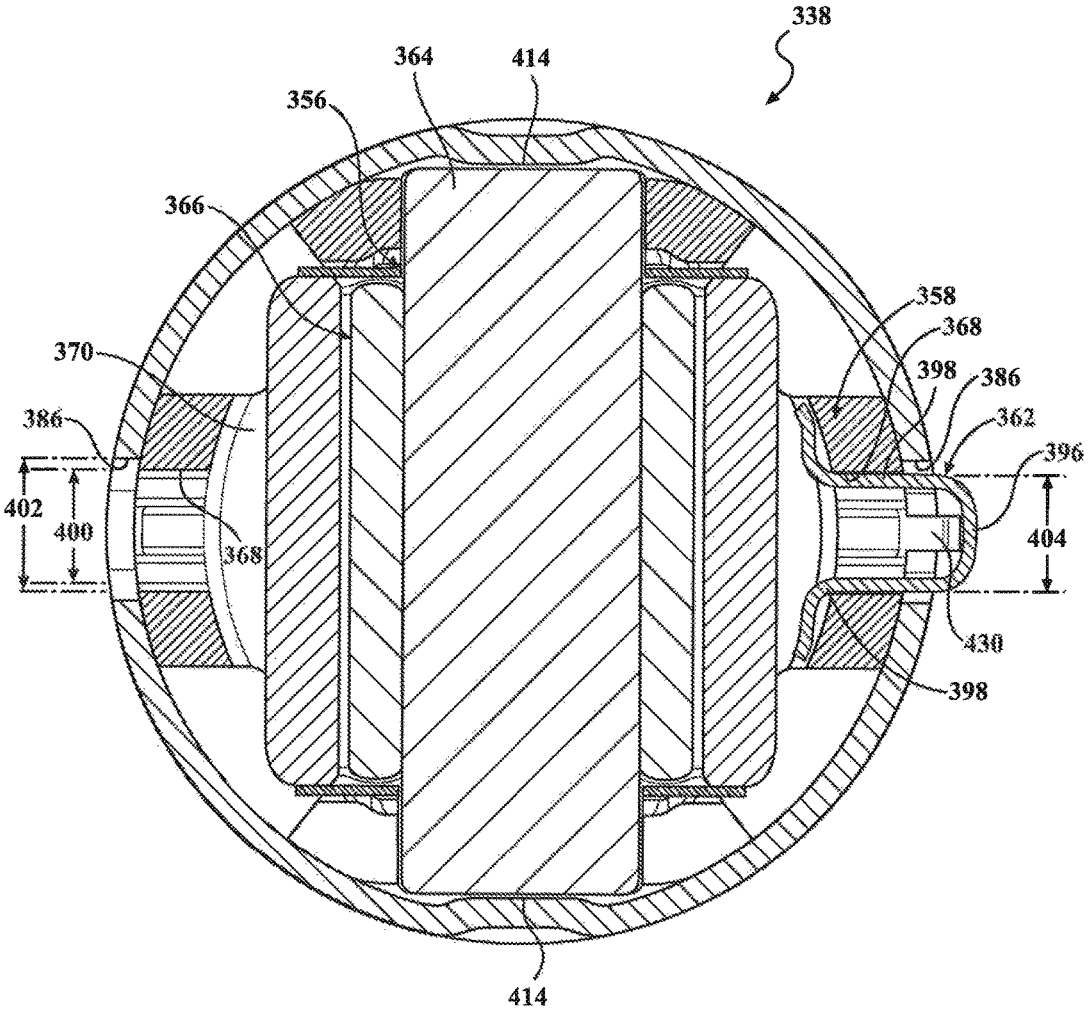
FIG. 28A is a sectional view taken along line 28A-28A in FIG. 26.
Figure 28B:
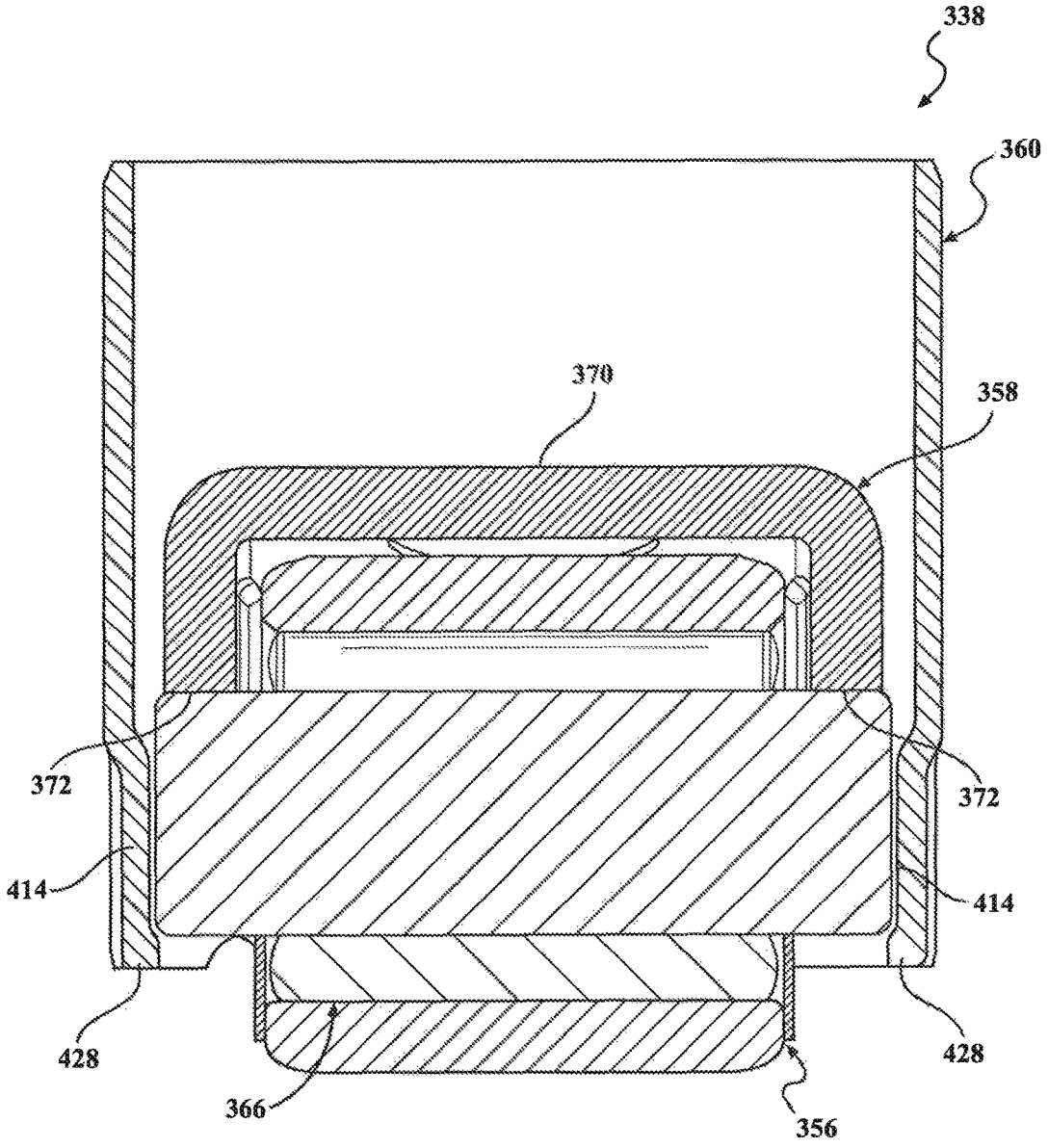
FIG. 28B is a sectional view taken along line 28B-28B in FIG. 27.
Figure 28C:
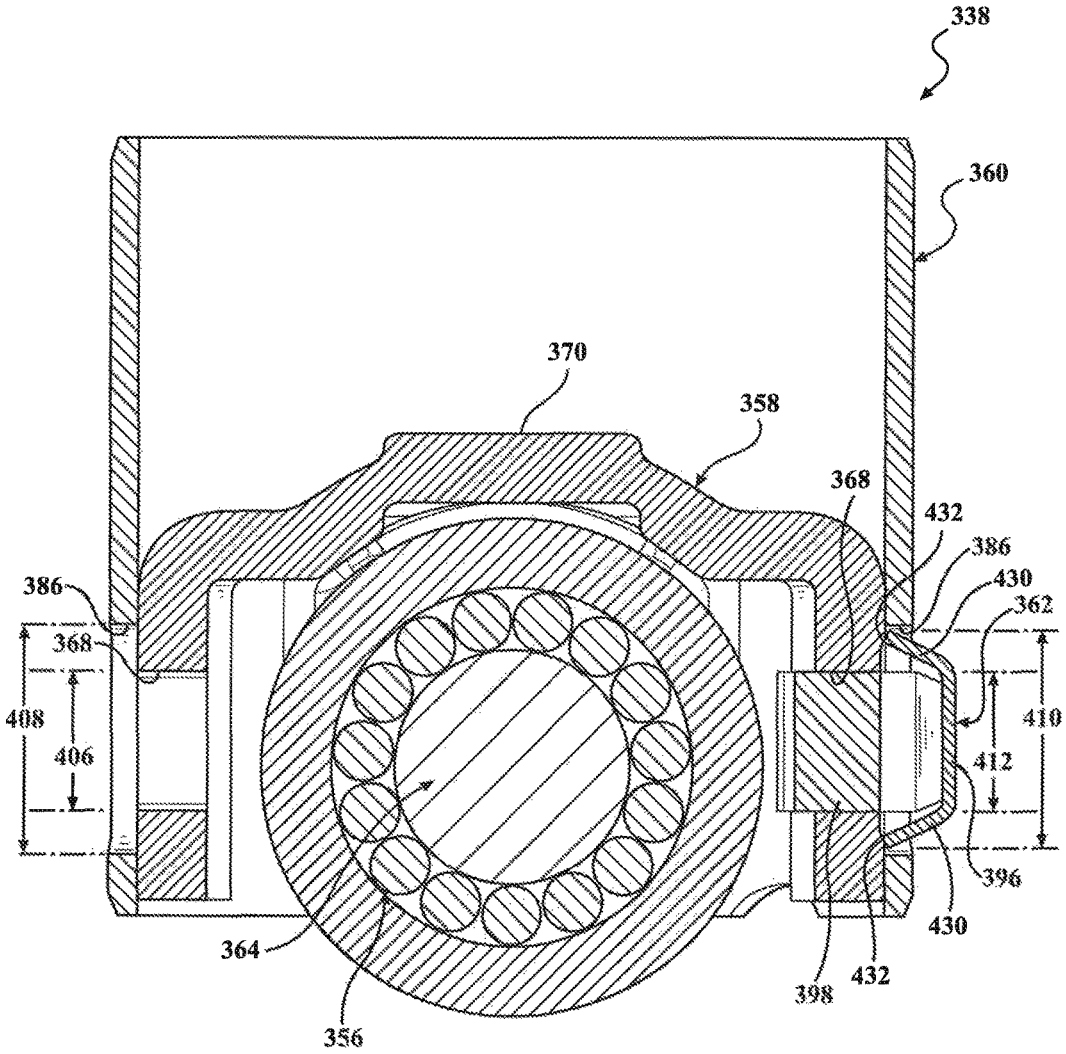
FIG. 28C is a sectional view taken along line 28C-28C in FIG. 27.

Referring now to FIG. 28A, in this fourth embodiment of the tappet assembly 338, the first aperture width 400 of the first aperture 368 is less than the second aperture width 402 of the second aperture 386, and the guide width 404 is less than both the first aperture width 400 and the second aperture width 402. As shown in FIG. 28C, the first aperture height 406 of the first aperture 368 is less than the second aperture height 408 of the second aperture 386, and the leg height 412 is less than both the first aperture height 406 and the second aperture height 408. Here, the guide height 410 is defined vertically between the projections 430, is less than the second aperture height 408, and is greater than both the first aperture height 406 and the leg height 412. It will be appreciated that this configuration ensures proper retention and alignment between the intermediate element 358 and the annular body 360 (see FIGS. 28A and 28C).

In this way, the tappet assembly 38, 138, 238. 338 of the present invention significantly reduces the cost and complexity of manufacturing and assembling high-pressure fuel systems 30 and associated components. Specifically, it will be appreciated that the configuration of the intermediate element 58, 158, 258, 358, the annular body 60, 160, 260, 360, and the ant-rotation clip 62, 162, 262, 362 facilitate simple installation of the bearing assembly 56, 156, 256, 356 while, at the same time, ensuring that the shaft 64, 164, 264, 364 is retained within the annular body 60, 160, 260, 360 until the bearing 66, 166, 266, 366 engages the camshaft lobe 32. Specifically, it will be appreciated that the configuration of the tappet assembly 38, 138, 238, 338 allows the shaft 64, 164, 264, 364 to be retained with respect to annular body 60, 160, 260, 360 until the tappet assembly 38, 138, 238, 338 is installed into the tappet cylinder 46 of the housing 36, thereby significantly reducing the cost and complexity of manufacturing and assembling the high-pressure fuel system 30. Moreover, it will be appreciated that the configuration of the tappet assembly 38, 138, 238, 338 allows the intermediate element 58, 158, 258 and the annular body 60, 160, 260, 360 to be assembled or otherwise attached together, such as via brazing, before being attached to the bearing assembly 56, 156, 256, 356, which thus allows for advantageous implementation of heat treatment or other processing without affecting the bearing assembly 56, 156, 256, 356 while, at the same time, ensuring proper alignment of and subsequent engagement with the bearing assembly 56, 156, 256, 356 in operation. Further, it will be appreciated that the present invention affords opportunities high-pressure fuel systems 30 with superior operational characteristics, such as improved performance, component life and longevity, efficiency, weight, load and stress capability, and packaging orientation.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A tappet assembly for use in translating force between a camshaft lobe and a fuel pump assembly via reciprocal movement within a tappet cylinder having a guide slot, said tappet assembly comprising:

a bearing assembly having a shaft and a bearing rotatably supported by said shaft for engaging the camshaft lobe;

an intermediate element having a first aperture, a shelf for engaging the fuel pump assembly, and a pair of arc-shaped bearing surfaces rotatably engaging said shaft when said bearing engages the camshaft lobe and said shelf engages the fuel pump assembly;

an annular body having a second aperture and at least one stop member abutting said intermediate element so as to align said first aperture with said second aperture;

an anti-rotation clip extending through said first aperture and said second aperture, said anti-rotation clip including a guide portion for engaging the guide slot of the tappet cylinder, and a pair of legs extending from said guide portion through said first aperture and said second aperture so as to simultaneously retain said intermediate element to said annular body and align said tappet assembly with the guide slot of the tappet cylinder and with said stop member so as to substantially prevent rotational and axial movement of said intermediate element with respect to said annular body.

2. The tappet assembly as set forth in claim 1, wherein said annular body has an outer surface and an inner surface with said second aperture extending therebetween.

3. The tappet assembly as set forth in claim 2, wherein said inner surface of said annular body defines a chamber with said stop member extending from said inner surface into said chamber.

4. The tappet assembly as set forth in claim 1, wherein said intermediate element has a retention member depending from said shelf with said first aperture extending through said retention member.

5. The tappet assembly as set forth in claim 1, wherein said intermediate element has a pair of lower members depending from said shelf each having an outwardly-opening U-shaped portion defining one of said arc-shaped bearing surfaces.

6. The tappet assembly as set forth in claim 1, wherein said second aperture of said annular body has a second aperture width and said guide portion of said anti-rotation clip has a guide width greater than said second aperture width.

7. The tappet assembly as set forth in claim 6, wherein said first aperture of said intermediate element has a first aperture width greater than said second aperture width of said annular body.

8. The tappet assembly as set forth in claim 1, wherein said second aperture of said annular body has a second aperture height and said guide portion of said anti-rotation clip has a guide height greater than said second aperture height.

9. The tappet assembly as set forth in claim 8, wherein said first aperture of said intermediate element has a first aperture height greater than said second aperture height of said annular body.

10. The tappet assembly as set forth in claim 8, wherein said legs of said anti-rotation clip have a leg height substantially equal to said second aperture height of said annular body.

11. The tappet assembly as set forth in claim 1, wherein said anti-rotation clip is manufactured from spring steel.

12. The tappet assembly as set forth in claim 1, wherein said annular body includes a pair of lower walls disposed adjacent to said shaft of said bearing assembly, said lower walls spaced from each other so as to limit axial movement of said shaft.

13. The tappet assembly as set forth in claim 1, wherein said bearing assembly further includes a pair of shields supported on said shaft of said bearing assembly with said bearing interposed between said shields.

14. The tappet assembly as set forth in claim 13, wherein said bearing includes an outer race and a plurality of rollers supported between said outer race and said shaft; and wherein said shields cooperate with said intermediate element so as to limit axial movement of said rollers and said outer race with respect to said shaft.

15. The tappet assembly as set forth in claim 8, wherein said intermediate element includes a pair of lock apertures; and wherein said bearing assembly further includes a saddle extending between said shields over said bearing, said saddle including a pair of opposing fingers for engaging said lock apertures so as to substantially retain said bearing assembly to said intermediate element and so as to substantially retain said shaft of said bearing assembly within said annular body in absence of engagement between said bearing and the camshaft lobe.

16. The tappet assembly as set forth in claim 1, wherein said intermediate element includes a pairs of hooks disposed in spaced relation above each of said arc-shaped bearing surfaces so as to substantially retain said shaft of said bearing assembly within said annular body in absence of engagement between said bearing and the camshaft lobe.

17. The tappet assembly as set forth in claim 1, wherein said shaft of said bearing assembly extends between shaft ends with a dimple defined in each of said shaft ends; and wherein said annular body includes a pair of inwardly-protruding retention elements spaced from each other so as to limit axial movement of said shaft and cooperating with said dimples so as to substantially retain said shaft of said bearing assembly within said annular body in absence of engagement between said bearing and the camshaft lobe.

18. The tappet assembly as set forth in claim 17, wherein said dimples are substantially concentrically aligned with said shaft.

19. The tappet assembly as set forth in claim 17, wherein said dimples of said shaft have a substantially concave profile.

* * * * *